US008883385B2

(12) United States Patent
Sakashita et al.

(10) Patent No.: US 8,883,385 B2
(45) Date of Patent: Nov. 11, 2014

(54) TONER, DEVELOPMENT AGENT, AND IMAGE FORMING APPARATUS USING THE SAME

(71) Applicants: Shingo Sakashita, Shizuoka (JP); Hiroshi Yamashita, Shizuoka (JP); Masahide Yamada, Shizuoka (JP); Shinya Nakayama, Shizuoka (JP); Atsushi Yamamoto, Shizuoka (JP); Yukiko Nakajima, Kanagawa (JP)

(72) Inventors: Shingo Sakashita, Shizuoka (JP); Hiroshi Yamashita, Shizuoka (JP); Masahide Yamada, Shizuoka (JP); Shinya Nakayama, Shizuoka (JP); Atsushi Yamamoto, Shizuoka (JP); Yukiko Nakajima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 19 days.

(21) Appl. No.: 13/705,811

(22) Filed: Dec. 5, 2012

(65) Prior Publication Data

US 2013/0157185 A1 Jun. 20, 2013

(30) Foreign Application Priority Data

Dec. 20, 2011 (JP) ..... 2011-278250
Oct. 5, 2012 (JP) ..... 2012-222631

(51) Int. Cl.
*G03G 9/097* (2006.01)
*G03G 9/08* (2006.01)

(52) U.S. Cl.
CPC ..... *G03G 9/08* (2013.01)
USPC ..... 430/108.4; 430/108.1; 430/109.4; 430/109.5

(58) Field of Classification Search
USPC ..... 430/108.1, 108.4, 109.4, 109.5
See application file for complete search history.

(56) References Cited

U.S. PATENT DOCUMENTS

| | | | | |
|---|---|---|---|---|
| 6,326,115 | B1 * | 12/2001 | Nakanishi et al. | 430/109.5 |
| 2005/0208405 | A1 * | 9/2005 | Ayaki et al. | 430/108.4 |
| 2006/0029875 | A1 | 2/2006 | Kamiyoshi et al. | |
| 2008/0166647 | A1 * | 7/2008 | Mang et al. | 430/108.4 |
| 2012/0258392 | A1 * | 10/2012 | Murata et al. | 430/105 |
| 2012/0282000 | A1 | 11/2012 | Nakayama et al. | |

FOREIGN PATENT DOCUMENTS

| | | |
|---|---|---|
| EP | 1 693 711 A1 | 8/2006 |
| JP | 63-038955 | 2/1988 |
| JP | 8-050368 | 2/1996 |
| JP | 2001-305796 | 11/2001 |

(Continued)

OTHER PUBLICATIONS

Diamond, "The Handbook of Imaging Materials," Marcel Dekker, NY, NY 1991.*

(Continued)

*Primary Examiner* — Peter Vajda
(74) *Attorney, Agent, or Firm* — Oblon, Spivak, McClelland, Maier & Neustadt, L.L.P.

(57) ABSTRACT

A toner includes a binder resin, a coloring agent, and a releasing agent containing two or more kinds of alkyl monoester compounds having a different number of carbon atoms in a range of from 30 to 50 carbon atoms. The toner has a crystallinity of 10% or more as measured by x-ray diffraction and/or the binder resin is a crystalline resin in an amount of 50% by weight or more of the binder resin. The two or more kinds of alkyl monoester compounds include a component A accounting for the largest amount ranging from 30% by weight to less than 50% by weight of the releasing agent and a component B accounting for the second largest amount ranging from 10% by weight to less than 50% by weight of the releasing agent.

12 Claims, 5 Drawing Sheets

(56) References Cited

FOREIGN PATENT DOCUMENTS

| | | | | |
|---|---|---|---|---|
| JP | 2009-014926 | 1/2009 | | |
| JP | 2010-077419 | 4/2010 | | |
| JP | 2010-151996 | 7/2010 | | |
| JP | 2011-018030 | 1/2011 | | |
| JP | 2012-042939 | 3/2012 | | |
| WO | WO 2011/074674 | * | 6/2011 | ..... G03G 9/0804 |

OTHER PUBLICATIONS

Extended Search Report issued Apr. 18, 2013 in European Patent Application No. 12198258.1.

* cited by examiner

TONER, DEVELOPMENT AGENT, AND IMAGE FORMING APPARATUS USING THE SAME

CROSS-REFERENCE TO RELATED APPLICATIONS

This patent application is based on and claims priority pursuant to 35 U.S.C. §119 to Japanese Patent Application Nos. 2011-278250 and 2012-222631, filed on Dec. 20, 2011 and Oct. 5, 2012, respectively, in the Japan Patent Office, the entire disclosures of which are hereby incorporated by reference herein.

BACKGROUND OF THE INVENTION

1. Field of the Invention

The present invention relates to a toner, a development agent, and an image forming apparatus that uses the toner and development agent.

2. Description of the Related Art

In electrophotography, electrostatic images (latent images) are formed on an image bearing member (typically photoreceptor) and developed with toner into toner images. The toner image is transferred to a recording medium, typically paper, and thereafter fixed thereon using heat, pressure, or both.

In an image forming apparatus employing a heating fixing system, since a large amount of energy is required in the fixing process of fusing the toner on the recording medium, fixing the toner at a low temperature is desirable in terms of saving energy.

To improve the low-temperature fixability of the toner, it is necessary to control the thermal characteristics of the binder resin that accounts for a large proportion of the toner material.

For example, JP-2010-077419-A describes a toner having a crystalline resin accounting for most of the binder resin to provide a good combination of low-temperature fixability and high-temperature stability by controlling the composition and the thermal characteristics of the crystalline resin.

In addition, JP-2009-014926-A describes using a toner containing two kinds of crystalline resins (preferably crystalline polyester resins) having different molecular weights as the binder resins under a particular fixing condition to improve the low-temperature fixability and prevent fixed images from cracking.

In addition, JP-2010-151996-A describes a toner containing two kinds of crystalline resins having different storage elastic moduli at 160° C. as the binder resin to provide a good combination of low-temperature fixability and the high-pressure preservability. Moreover, JP-3287733-B (JP-H8-50368) describes using an ester wax having ester compounds having the same total number of carbon atoms in an amount of 50% by weight to 95% by weight as a releasing agent, so that the releasing agent drastically melts at a particular temperature (melting point) to provide good transparency for a transparent sheet while improving the low-temperature fixability, the hot offset resistance, and the high-temperature stability.

The present inventors have found that, in toner having a crystalline resin as the binder resin, as the ratio of the crystalline resins increases from 30% by weight to 40% by weight, 50% by weight, and so on, low-temperature fixability improves, particularly when the crystalline resin is the major component of the binder resin. However, this also invites peeling-off of the image during the low-temperature fixing process and occurrence of slight cold offset, which are large impediments to further improvement of low-temperature fixing.

In addition, as low-temperature fixability improves, it is possible to lower the surface temperature of a heating medium (such as a roller or a belt) during fixing, thereby decreasing the power consumption of the image forming apparatus. However, as the surface temperature of the heating medium decreases, the temperature fluctuates greatly particularly in the case of continuous printing, which causes problems such as production of defective images and winding of the recording medium around the heating medium. This tendency is particularly pronounced when using a releasing agent having a low melting point and demonstrating a releasing effect by drastic fusion at a particular temperature.

In addition, with toner having a binder resin high in crystalline resin, the high-temperature stability of the toner mainly depends on the melting point of the crystalline resin. However, the melting point of the crystalline resin drops significantly when the releasing agent contains a component that melts at a low temperature, thereby degrading the high-temperature stability significantly. Furthermore, the low-melting-temperature component of the releasing agent tends to be volatile, which creates a problem of contamination of the interior of the machine.

SUMMARY OF THE INVENTION

Therefore, the present invention provides a toner having a binder resin containing a high proportion of crystalline resin, in particular a toner having a binder resin that has crystalline resin as the main ingredient, which has superior low-temperature fixability, stable releasability despite temperature fluctuation during continuous printing, and high-temperature stability, and which does not cause contamination of the interior of the machine.

In view of the foregoing, the present invention provides a toner including a binder resin, a coloring agent, and a releasing agent containing two or more kinds of alkyl monoester compounds having a different number of carbon atoms in a range of from 30 to 50 carbon atoms. The toner has a crystallinity of 10% or more as measured by x-ray diffraction and/or the binder resin is a crystalline resin in an amount of 50% by weight or more of the binder resin. The two or more kinds of alkyl monoester compounds include a component A accounting for the largest amount ranging from 30% by weight to less than 50% by weight of the releasing agent and a component B accounting for the second largest amount ranging from 10% by weight to less than 50% by weight of the releasing agent.

BRIEF DESCRIPTION OF THE DRAWINGS

Various other objects, features, and attendant advantages of the present invention will be more fully appreciated as the same becomes better understood from the detailed description when considered in connection with the accompanying drawings, in which like reference characters designate like corresponding parts throughout and wherein.

DETAILED DESCRIPTION OF THE PRESENT DISCLOSURE

Toner

Figure 1A:
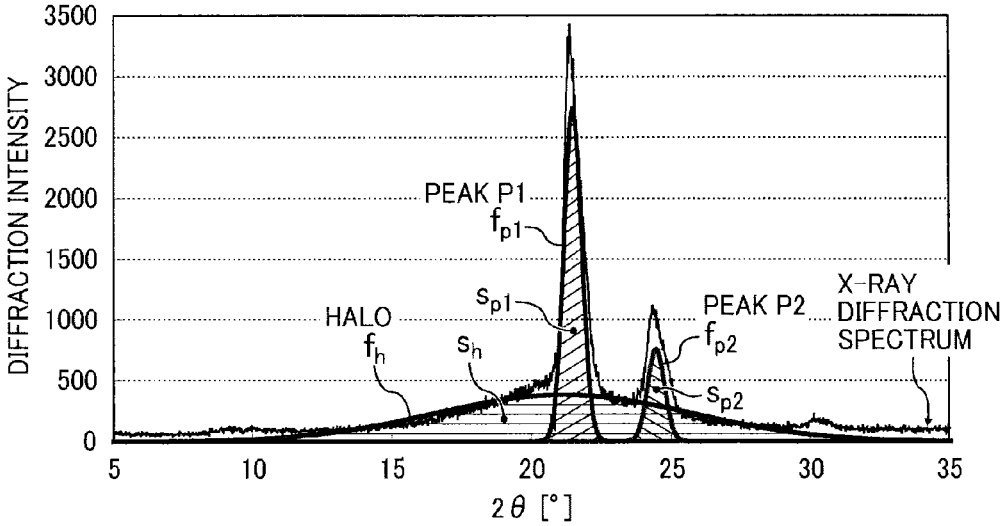
FIGS. 1A and 1B are examples of graphs obtained after fitting when calculating the crystallization of the toner of the present disclosure.

The toner of the present disclosure contains at least a binder resin, a coloring agent, and a releasing agent. The binder resin contains a crystalline resin in an amount of 50% by weight or more of the binder resin and/or the toner has a crystallinity of 10% or more by X ray diffraction measuring. In addition, the releasing agent has two or more kinds of alkyl monoester compounds having different number of carbon atoms in a range of from 30 to 50 and a component A accounting for the largest amount in the two or more kinds of alkyl monoester compounds ranges from 30% by weight to less than 50% by weight of the releasing agent and, a component B for the second largest amount, ranges from 10% by weight to less than 50% by weight.

That is, by using the releasing agent having the characteristics described above and satisfying at least one of the requisites that the toner has a crystallinity of 10% or more as measured by x-ray diffraction and that the binder resin contains a crystalline resin in an amount of 50% by weight or more based on the content of the binder resin, the present disclosure provides the toner having excellent low-temperature fixability, a stable releasability against the temperature variation during continuous printing, and an excellent high-temperature stability without causing contamination in the machine, a development agent containing the toner, and an image forming apparatus using those.

Binder Resin

The binder resin in the present disclosure preferably contains a crystalline resin in an amount of 50% by weight or more based on the binder resin and substantially the main component of the binder resin is the crystalline resin. To maximally exhibit an excellent combination of the low-temperature fixability and the high-temperature stability by the crystalline resin, the binder resin more preferably has the crystalline resin in an amount of 65% by weight or more and furthermore preferably 80% by weight or more. When the content of the crystalline resin is too small, the drastic thermal property of the binder resin does not easily exhibit on the viscoelasticity of the toner so that it is difficult to provide a good combination of the low-temperature fixability and the high-temperature stability. On the other hand, as the ratio of the crystalline resins accounting for in the binder resin increases from 30% by weight, 40% by weight, 50% by weight, and so on, the low-temperature fixability becomes excellent particularly when the crystalline resin is the major component of the binder resin. However, this also invites peeling-off of the image during the low-temperature fixing process and minute cold offset, which is a large issue to furthermore improve the low-temperature fixing. This is solved by using the releasing agent particularly used in the present disclosure.

The crystallinity of the crystalline resin in the present disclosure represents a characteristic which drastically softens by heat with a ratio {softening temperature to the maximum peak temperature (melting point) of the melting heat)} of the softening temperature measured by an elevated flow tester to the maximum peak temperature (melting point) measured by a differential scanning calorimeter (DSC) of preferably from 0.80 to 1.55 and a resin having this characteristic is defined as the crystalline resin.

In addition, the non-crystallinity in the present disclosure represents a characteristic which slowly softens by heat with a ratio (softening temperature to the maximum peak temperature of the melting heat) of the softening temperature measured by an elevated flow tester to the maximum peak temperature measured by a differential scanning calorimeter of greater than 1.55 and a resin having this characteristic is defined as the non-crystalline resin.

The softening temperature of the resin and the toner can be measured by an elevated flow tester (e.g., CFT-500D, manufactured by SHIMADZU CORPORATION) as follows: Impart a load of 30 kg/cm$^2$ to one gram of a sample resin by a plunger while heating the sample resin at a temperature rising speed of 3° C./min. to extrude it from a nozzle having a diameter of 0.5 mm and a length of 1 mm; Plot the plunger descending amount of the flow tester against the temperature; and determine the temperature at which a half of the sample has flown out as the softening temperature.

The maximum peak temperature of the melting heat of the resin and the toner can be measured by a differential scanning calorimeter (DSC) (for example, TA-60W and DSC-60, manufactured by SHIMADZU CORPORATION) as follows: As preliminary treatment, melt the sample supplied to the measurement of the maximum peak temperature of the melting heat at 130° C.; Cool it down from 130° C. to 70° C. at a temperature falling speed of 1.0° C./min.; Cool it down from 70° C. to 10° C. at a temperature falling speed of 0.5° C./min.; Heat the sample by a DSC at a temperature rising speed of 20° C./min. once to measure the change of absorption and generation of heat; Draw a graph of "amount of absorption and generation of heat" and "temperature"; Define the endotherm peak temperature observed between 20° C. to 100° C. as "Ta*"; If there are multiple endotherm peaks, the temperature at which the amount of endotherm is the largest is determined as Ta*; Thereafter, preserve the sample at (Ta*−10)° C. for six hours and at (Ta*−15)° C. for another six hours; Then, cool down the sample by DSC to 0° C. at a temperature falling speed of 10° C./min.; Heat it at a temperature rising speed of 20° C./min. to measure the change of absorption and generation of heat; Draw a graph as described above; and Determine the temperature corresponding to the maximum peak of the amount of absorption and generation of heat as the maximum peak temperature of the melting heat.

Crystalline Resin

There is no specific limit to the crystalline resin of the present disclosure. Any typical resin which satisfies the requisites described above is suitably usable. Specific examples thereof include, but are not limited to, crystalline polyester resins, urethane-modified crystalline polyester resins, urea-modified crystalline polyester resins, crystalline polyurethane resins, and crystalline polyurea resins. Among these, in terms of the crystallinity and the hardness, urethane-modified crystalline polyester resins having a urethane bonding and/or urea bonding, urea-modified crystalline polyester resins, crystalline polyurethane resins, and crystalline polyurea resins are preferable. Furthermore, urethane-modified crystalline polyester resins and urea-modified crystalline polyester resins are more preferable in terms of reducing the amount of a raw material monomer of the resin and oligomer components as by-products and suppress deterioration of the high-temperature stability ascribable to these components.

Crystalline Polyester Resin

Specific examples of the crystalline polyester resin include, but are not limited to, polycondensed polyester resins synthesized by polycondensation of a diol component and a carboxylic acid component, lactone ring opening polymers, and polyhydroxycarboxylic acid. Among these, the polycondensed polyester resins synthesized by polycondensation of a diol and a carboxylic acid are preferable in terms of demonstration of the crystallinity.

Diol Component

As the diol component, aliphatic diols are preferable and the number of carbon atoms in the chain is preferably from 2 to 36. The aliphatic diols are classified into the straight chain type and the branch-chain type. The straight-chain type aliphatic diols are preferable and the straight-chain type aliphatic diols having four to six carbon atoms are more preferable. As the diol component, multiple diol components can be used. The content of the straight-chain type aliphatic diols is preferably 80% by mol or higher and more preferably 90% by mol or higher based on the total content of the diol component. When the content is within this range, the crystallinity of the resin ameliorates and the combination of the low-temperature fixability and the high-temperature stability is good, which is preferable in terms of the tendency of improvement of the hardness of the resin.

Specific examples of the straight-chain type aliphatic diols include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,15-pentadecane diol, 1,16-hexane decane diol, 1,17-heptadecane diol, 1,18-octadecane diol, and 1,20-eicosane diol. Among these, considering the availability, ethylene glycol, 1,3-propane diol, 1,4-butane diol, 1,6-hexane diol, 1,9-nonane diol, and 1,10-decane diol are preferable and 1,4-butane diol and 1,6-hexane diol are more preferable.

Specific examples of optional diols include, but are not limited to, aliphatic diols having 2 to 36 carbon atoms other than the specified above (e.g., 1,2-propylene glycol, 1,3-butane diol, hexane diol, octane diol, decane diol, dodecane diol, tetradecane diol, neopentyl glycol, and 2,2-diethyl-1,3-propane diol); alkylene ether glycols having 4 to 36 carbon atoms (e.g., diethylene glycol, triethylene glycol, dipropylene glycol, polyethylene glycol, polypropylene glycol, and polytetramethylene ether glycol); alicyclic diols having 4 to 36 carbon atoms (e.g., 1,4-cyclohexane dimethanol and hydrogenated bisphenol); Adducts of the alicyclic diols specified above with 1 mol to 30 mols of alkylene oxide (hereinafter referred to as AO) such as ethylene oxide (hereinafter referred to as EO), propylene oxide (hereinafter referred to as PO), and butylene oxide (hereinafter referred to as BO); adducts of bisphenols (e.g., bisphenol A, bisphenol F, and bisphenol S) with 2 mols to 30 mols of AO (EO, PO, BO, etc.); polylactone diols (e.g., polyε-caprolactone diol); and polybutadiene diol).

Specific examples of optional tri- or higher alcohol components include, but are not limited to, tri- or higher aliphatic polyols having 3 to 36 carbon atoms (e.g., alkane polyools and inner or inter molecular dehydrated compounds thereof, e.g., glycerine, trimethylol ethane, trimethylol propane, pentaerythritol, sorbitol, sorbitane, and polyglycerine); Sugars and derivatives thereof (e.g., sucrose and methyl glucoside); adducts of trisphenols (e.g., triphenol PA) with 2 mols to 30 mols of AO; adducts of novolac resins (e.g., phenolic novolac and cresol novolac) with 2 mols to 30 mols of AO; and copolymers of acrylic polyol (e.g., copolymers of hydroxyethyl(meth)acrylate and another vinyl-based monomer). Among these, tri- or higher aliphatic polyols and adducts of novolac resins with AO are preferable and adducts of novolac resins with AO are more preferable.

Dicarboxylic Acid

Preferred specific examples of the carboxylic acid components include, but are not limited to, aliphatic dicarboxylic acids and aromatic dicarboxylic acids. The aliphatic dicarboxylic acids are classified into the straight chain type and the branch-chained type. The straight chain type dicarboxylic acids are more preferable. Among these straight chain type dicarboxylic acids, saturated aliphatic dicarboxylic acids having from 6 to 12 carbon atoms are particularly preferable.

Specific examples of the dicarboxylic acid include, but are not limited to, alkane dicarboxylic acids having 4 to 36 carbon atoms such as succinic acid, adipic acid, azelaic acid, sebacic acid, dodecane dicarboxylic acid, tetradecane dicarboxylic acid, hexadecane dicarboxylic acid, and octadecane dicarboxylic acid; alicyclic dicarboxylic acids having 6 to 40 carbon atoms such as dimer acid (dimerized linolic acid); alkene dicarboxylic acids having 4 to 36 carbon atoms such as alkenyl succinic acids such as dodecenyl succinic acid, pentadecenyl succinic acid, and octadecenyl succinic, maleic acid, fumaric acid, and citraconic acid; and aromatic dicarboxylic acids having 8 to 36 carbon atoms such as phthalic acid, isophthalic acid, terephthalic acid, t-butyl isophthalic acid, 2,6-naphthalene dicarboxylic acid, and 4,4'-biphenyl dicarboxylic acid).

Specific examples of the optional polycarboxylic acids having three or more hydroxyl groups include, but are not limited to, aromatic polycarboxylic acids having 9 to 20 carbon atoms (e.g., trimellitic acid and pyromellitic acid).

As the dicarboxylic acid or polycarboxylic acids having three or more hydroxyl groups, anhydrides or lower alkyl esters (e.g., methyl esters, ethyl esters, or isopropyl esters) having one to four carbon atoms can be used.

Among these dicarboxylic acids, it is preferable to use the aliphatic dicarboxylic acids (preferably adipic acid, sebacic acid, and dodecane dicarboxylic acid) singly or in combination. Copolymers of the aliphatic dicarboxylic acids and the aromatic dicarboxylic acids (preferably isophthalic acid, terephthalic acid, t-butyl isophthalic acid, and lower alkyl esters thereof) are also preferable. The amount of copolymerized aromatic dicarboxylic acid is preferably 20% by mol or less.

Lactone Ring-Opening Polymer

The lactone ring-opening polymers as the polyester resin can be obtained by, for example, ring-opening polymerizing a lactone such as a monolactone (the number of ester groups is one in the ring) having 3 to 12 carbon atoms such as β-propio lactone, γ-butylo lactone, δ-valero lactone, and ε-capro lactone using a catalyst such as a metal oxide and an organic metal compound. Among these, ε-capro lactone is preferable in terms of crystallinity.

In addition, lactone ring-opening polymers having a hydroxyl group at their end obtained by ring-opening polymerizing the lactones specified above using a glycol (e.g., ethylene glycol and diethylene glycol) as an initiator are suitable. Also the end can be modified to be a carboxyl group. Products available from the market can be also used. These are, for example, high-crystalline polycapro lactones such as PLACCEL series H1P, H4, H5, and H7 (manufactured by DAICEL CORPORATION).

Polyhydroxy Carboxylic Acid

Polyhydroxy carboxylic acids as the polyester resins are obtained by direct dehydrocondensation of hydroxycarboxylic acid such as a glycolic acid, lactic acid (L-, D- and meso form). However, it is preferable to obtain them by ring-opening a cyclic ester (the number of ester groups in the ring is two or three) having 4 to 12 carbon atoms corresponding to an inter two or three molecule dehydrocondensed compound of a hydroxycarboxylic acid such as glycolide and lactide (L-, D- and meso form) with a catalyst such as a metal oxide and an organic metal compound in terms of controlling the molecular weight. Among these, preferable cyclic esters are L-lactide and D-lactide in light of crystallinity. In addition, these polyhydrocarboxylic acids that are modified to have a hydroxy group or a carboxyli group at the end are also suitable.

Urethane-Modified Crystalline Polyester Resin

The urea-modified polyester resin can be obtained by, for example, reaction between the crystalline polyester resins mentioned above and a di- or higher isocyanate compound or reaction a polyester resin having an isocyanate group at its end and a polyol component.

Di- or Higher Isocyanate Component

Specific examples of the isocyaante compounds include, but are not limited to, aromatic isocyanates, aliphatic isocyanates, alicyclic isocyanates, and aromatic alicphatic isocyanates (among these, for example, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, modified diisocyanates thereof (modified compounds having a urethane group, a cabodiimide group, an allophanate group, a urea group, a biuret group, a uretdione group, a uretimine group, an isocyanulate group, and an oxazoline group), and mixtures thereof, in which the number of carbon atoms specified above excludes the number of carbon atoms in NCO group). Optionally, tri- or higher isocynates can be used in combination therewith.

Specific examples of the aromatic isocyanates include, but are not limited to, 1,3- and/or 1,4-phenylene diisocyanate (TDI), crude TDI, 2,4'- and/or 4,4'-diphenyl methane diisocyanate (MDI), phosgened compounds of crude MDI, 1,5-naphtylene diisocyanate, 4,4',4"-triphenyl methane triisocyanate, and m- and p-isocyanate phenyl sulphonyl isocyanate.

Specific examples of the aliphatic isocyanates include, but are not limited to, etyhlene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl) fumarate, bis(2-isocyanato ethyl) carbonate, and 2-isocyanatoethyl-2,6-diisocyanato hexanoate.

Specific examples of the alicyclic isocyanates include, but are not limited to, isophorone diisocyanate (IPDI), dicyclo hexyl methane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate.

Specific examples of the aromatic aliphatic diisocyanates include, but are not limited to, m- and/or p-xylylene diisocyanate (XDI), α,α,α',α'-tetramethyl xylylene diisocyanate (TMXDI).

Specific examples of the modified compounds of the diisocyanates include, but are not limited to, modified compounds having a urethane group, a cabodiimide group, an allophanate group, a urea group, a biuret group, a uretdione group, a uretimine group, an isocyanulate group, and an oxazoline group. To be specific, these are: modified MDI such as urethane modified MDI, carbodiimide modified MDI, and trihydrocarbyl phosphate modified MDI), modified compounds of diisocyanates such as urethane modified TDI, and mixtures thereof such as modified MDI and urethane modified TDI (prepolymer containing isocyanate).

Among these, aromatic diisocyanates having 6 to 15 carbon atoms, aliphatic diisocyanates having 4 to 12 carbon atoms, alicyclic diisocyanates having 4 to 15 carbon atoms are preferable, in which the number of carbon atoms excludes the number of carbon atoms in NCO group. Among these, TDI, MDI, HDI, hydrogenated MDI, and IPDI are particularly preferable.

Urea-Modified Crystalline Polyester Resin

The urea-modified crystalline polyester resin has, for example, an isocyanate group at its end.

This is obtained by reaction of a crystalline polyester resin and an amine compound.

Di- or Higher Amine Component

Specific examples of the amine component include, but are not limited to, aliphatic amines and aromatic amines. Among these, aliphatic diamines having 2 to 18 carbon atoms and aromatic diamines having 6 to 20 carbon atoms are suitable. Optionally, tri- or higher amines can be used.

Specific examples of the aliphatic diamines having 2 to 18 carbon atoms include, but are not limited to, alkylene diamines such as ethylene diamine, propylene diamine, trimethylene diamine, tetramethylene diamine, and hexamethylene diamine; polyalkylene diamines having 4 to 18 carbon atoms such as diethylene triamine, iminobis propyl amine, bis(hexamethylene)triamine, triethylene tetramine, tetraethylne pentamine, and pentaethylene hexamine; substituted compounds thereof with an alkyl having 1 to 4 carbon atoms or a hydroxyl alkyl having 2 to 4 carbon atoms such as dialkyl aminopropyl amine, trimethyl hexamethylene diamine, aminoethyl ethanol amine, 2,5-dimethyl-2,5-hexamethylene diamine, and methyl iminobispropyl amine; alicyclic or heterocyclic aliphatic diamines such as alicyclic diamine having 4 to 15 carbon atoms such as 1,3-diamino cyclehexane, isophorone diamine, menthene diamine, 4,4'-methylene dicyclohexane diamine (hydrogenated methylene dianiline and heterocyclic diamine having 4 to 15 carbon atoms such as piperazine, N-aminoethyl piperazine, 1,4-diaminoethyl piperazine, 1,4,-bis(2-amino-2-methylpropyl)piperazine, 3,9-bis(3-aminopropyl)-2,4,8,10-tetraoxaspiro[5,5]undecane; and aromatic aliphatic amines having 8 to 15 carbon atoms such as xylylene diamine, tetrachlor-p-xylylene diamine.

Specific examples of the aromatic diamines having 6 to 20 carbon atoms include, but are not limited to, non-substituted aromatic diamines such as 1,2-, 1,3, or 1,4-phenylene diamine, 2,4,'- or 4,4'-diphenyl methane diamine, crude diphenyl methane diamine (polyphenyl polymethylene polyamine), diaminodiphenyl sulfone, bendidine, thiodianiline, bis(3,4-diaminophenyl) sulfone, 2,6-diaminopilidine, m-aminobenzyl amine, triphenyl methane-4,4',4"-triamine, and naphtylene diamine; aromatic diamines having a nuclear substitution alkyl group having one to four carbon atoms such as 2,4- or 2,6-tolylene diamine, crude tolylene diamine, diethyle tolylene diamine, 4,4'-diamino-3,3'-dimethyldiphenyl methane, 4,4'-bis(o-toluidine), dianisidine, diamino ditolyl sulfone, 1,3-dimethyl-2,4-diaminobenzene, 1,3-dimethyl-2,6-diaminobenzene, 1,4-diisopropyl-2,5-diamino benzene, 2,4-diamino mesitylene, 1-methyl-3,5-diethyl-2,4-diamino benzene, 2,3-dimethyl-1,4-diamino naphthalene, 2,6-dimethyl-1,5-diamino naphthalene, 3,3',5,5'-tetramethyl bendizine, 3,3',5,5'-tetramethyl-4,4'-diamino diphenyl methane, 3,5-diethyl-3'-methyl-2',4-diamino diphenyl methane, 3,3' diethyl-2,2'-diaminodiphenyl methane, 4,4'-diamino-3,3'-dimethyl diphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminophenyl sulfone; mixtures of isomers thereof with various ratios; aromatic diamines having a nuclear substitution electron withdrawing group (such as halogen (e.g., Cl, Br, I, and F), alkoxy groups such as methoxy group and ethoxy group, and nitro group) such as methylene bis-o-chloroaniline, 4-chlor-o-phenylene diamine, 2-chlor-1,4-phenylene diamine, 3-amino-4-chloroaniline, 4-bromo-1,3-phenylene diamine, 2,5-dichlor-1,4-phenylene diamine, 5-nitro-1,3-phenylene diamine, 3-dimethoxy-4-aminoaniline; 4,4'-diamino-3,3'-dimethyl-5,5'-dibromo-diphenyl methane, 3,3'-dichlorobenzidine, 3,3' dimethoxy benzidine, bis(4-amino-3-chlorophenyl)oxide, bis(4-amino-2-chlorophenyl)propane, bis(4-amino-2-chlorophenyl) sulfone, bis(4-amino-3-methoxyphenyl) decane, bis(4-aminophenyl)sulfide, bis(4-aminophenyl) telluride, bis(4-aminophenyl) selenide, bis(4-amino-3-methoxyphenyl)disulfide, 4,4'-methylene bis(2-iodoaniline), 4,4'-methylene bis(2-bromoaniline), 4,4'-methylene bis(2-fluoroaniline), 4-aminophenyl-2-chloroaniline); aromatic diamines having a secondary amino group such as the non-substituted aromatic diamines specified above, the aromatic diamines having a nuclear substitution alkyl group having one to four carbon atoms, mixtures of isomers thereof with various mixing ratio, compounds in which part or entire of the primary amine group of the aromatic diamines having a nuclear substitution electron withdrawing group specified above is substituted with a lower alkyl group such as methyl group and ethyl group to be a tertiary amino group, 4-4'-di(methylamino)diphenyl methane, and 1-methyl-2-methylamino-4-aminobenzene.

In addition to those, specific examples of the tri- or higher amines include, but are not limited to, polyamide polyamines (low-molecular weight polyamide polyamines obtained by condensation of dicarboxylix acid (e.g., dimeric acid) and excessive (2 mols or more per mol of acid) polyamines (e.g., the alkylene diamines specified above and polyalkylene polyamines specified above) and hydrogenated compounds of cyanoethylated polyether polyamines (e.g., polyether polyols such as polyalkeylene glycol).

Crystalline Polyurethane Resin

Among the crystalline polyurethane resins, polyurethane resins synthesized from a diol component and a diisocyanate component are suitably used. Optionally, tri- or higher alcohol components and isocyanate components can be used.

Specific examples of the diol component and the diisocyanate component and the tri- or higher alcohol components and isocyanate components are the same as mentioned above.

Crystalline Polyurea Resin

Among the crystalline polyurea resins, crystalline polyurea resins synthesized from a diamine component and a diisocyanate component are suitably used. Optionally, tri- or higher amine components and isocyanate components can be used.

Specific examples of the diamine component and the diisocyanate component and the tri- or higher amine components and isocyanate components are the same as mentioned above.

The maximum peak temperature (melting point) of the melting heat of the crystalline resin described above is preferably from 45° C. to 70° C., more preferably from 53° C. to 65° C., and particularly preferably from 58° C. to 62° C. in terms of the combination of the low-temperature fixability and the high-temperature stability. When the maximum peak temperature is too low, the low-temperature fixability ameliorates but the high-temperature stability tends to deteriorate and the toner and the carrier tend to agglomerate due to stirring stress in the development device, which is not preferable. By contrast, when the maximum peak temperature is too high, the high-temperature stability ameliorates but the low-temperature fixability tends to deteriorate, which is not preferable.

The ratio {the softening temperature to the maximum peak temperature of (melting point) the melting heat} of the softening temperature to the maximum peak temperature (melting point) of the melting heat of the crystalline resin is preferably from 0.80 to 1.55, more preferably from 0.85 to 1.25, furthermore preferably from 0.90 to 1.20, and particularly preferably from 0.90 to 1.19. A resin with this ratio having a value closer to 1.00 has a characteristic of drastic softening and is excellent in terms of having a good combination of the low-temperature fixability and the high-temperature stability.

It is preferable that the crystalline resin has a urethane bonding and/or urea bonding and is formed of two kinds of crystalline resins having different molecular weights, i.e., a crystalline resin D and a crystalline resin E. This tends to widen the fixing range. In addition, since adjusting the crystallinity is relatively easy and the hardness of the crystalline resin is improved, the stress resistance of the toner tends to ameliorate, which is preferable.

The weight average molecular weight (Mw) of the crystalline resin D is preferably from 10,000 to 40,000, more preferably from 15,000 to 35,000, and particularly preferably from 20,000 to 30,000. When the molecular weight is too small, the high-temperature stability of the toner tends to deteriorate and when the molecular weight is too large, the low-temperature fixability of the toner tends to deteriorate, which is not preferable.

The weight average molecular weight (Mw) of the crystalline resin E is preferably from 40,000 to 300,000 and particularly preferably from 50,000 to 150,000 in terms of the high-temperature stability and the low-temperature fixability. When the molecular weight is too small, the hot offset resistance tends to deteriorate and when the molecular weight is too large, the toner tends not to melt sufficiently at low temperatures during fixing, which leads to peeling-off of the image. That is, the low-temperature fixability of the toner tends to deteriorate, which is not preferable.

The difference of Mw between the crystalline resin D and the crystalline resin E is preferably 5,000 or more and more preferably 10,000 or more. When the molecular weight difference is too small, the fixing range of the toner tends to small, which is not preferable.

The content ratio (D/E) of the crystalline resin D to the crystalline resin E is preferably from 95/5 to 70/30. When the content ratio of D is too large, the hot offset resistance of the toner tends to deteriorate and when the content ratio of E is too large, the low-temperature fixability of the toner tends to deteriorate, which is not preferable.

In the present disclosure, the weight average molecular weight (Mw) of the resin can be measured by using a gel permeation chromatography (GPC) measuring device (for example, GPC-8220 GPC, manufactured by TOSOH CORPORATION). The column is TSK gel Super HZM-M 15 cm triplet (manufactured by TOSOH CORPORATION). The resin to be measured is dissolved to obtain a 0.15% by weight solution of tetrahydrofuran (THF) (containing a stabilizer, manufactured by WAKO PURE CHEMICAL INDUSTRIES, LTD.) followed by filtration using a filter having an opening of 0.2 p.m. The resultant filtrate is used as a sample. Infuse 100 μA of the THF sample solution into the measuring instrument under the condition that the temperature is 40° C. and the flow speed is 0.35 ml/min. Calculate the molecular weight of the sample by the relationship between the logarithm value of the standard curve made from several kinds of the monodispersed polystyrene standard samples and the count value. The monodispersed polystyrene standard samples are: Showdex STANDARD Std. No S-7300, S-210, S-390, S-875, S-1980, S10.9, S-629, S-3.0, and S-0.580 (manufactured by SHOWA DENKO K.K.) and toluene. An refractive index (RI) detector is used as the detector.

Block resins that have crystalline portions and non-crystalline portions are suitable as the crystalline resin of the present disclosure. The crystalline resins specified above can be used for the crystalline portions. As resins for use in forming the non-crystalline portions, specific examples thereof include, but are not limited to, polyester resins, polyurethane resins, and polyurea resins. The composition of these non-crystalline portions is the same as that of the crystalline portion. Specific examples of the monomer for use include, but are not limited to, the diol components specified above, the dicarboxylic acid components specified above, the diisocyanate components specified above, and the diamine components specified above. Any combination thereof that can form a non-crystalline resin is suitable.

The crystalline resin E can be obtained by polymerization caused by reaction between a crystalline resin precursor E' having a functional group at its end which is reactive with an active hydrogen group and a resin having an active hydrogen group or a cross-linking agent or an elongation agent having an active hydrogen group in the toner manufacturing process. The crystalline resin precursor E' is obtained by reacting the resins mentioned above such as the crystalline polyester resin, the urethane modified crystalline polyester resin, the urea modified crystalline polyester resin, the crystalline polyurethane resin, and the crystalline polyurea resin with a compound having a functional group reactive with the active hydrogen group.

There is no specific limit to the functional group reactive with an active hydrogen group. Specific examples thereof include, but are not limited to, functional groups such as an isocyaante group, an epoxy group, a carboxylic acid group, and an acid chloride group. Among these, an isocyanate group is preferable in terms of the reaction property and the stability. A specific example of the compound having an isocyanate group is the diisocyanate component described above.

To obtain the crystalline resin precursor E', for example, in a case of the reaction of the crystalline polyester resin mentioned above and the diisocyanate component mentioned above, it is preferable to use a crystalline polyester resin having a hydroxy group at its end as the crystalline polyester resin. The crystalline polyester resin having a hydroxy group is obtained by reaction conducted at an equivalent ratio of the hydroxy group [OH] to the carboxylic group [COOH] for the ratio of the diol component to the dicarboxylic acid component from 2/1 to 1/1, more preferably from 1.5/1 to 1/1, and particularly from 1.3/1 to 1.02/1.

With regard to the usage amount of the compound having a functional group reactive with an active hydrogen group, for example, in a case of the crystalline resin precursor E' obtained by reacting a crystalline polyester resin having a hydroxy group with a diisocyanate component, the ratio of the diisocyanate component represented by the equivalent ratio {[NCO]/[OH]} of the isocyanate group [NCO] to the hydroxy group [OH] of the crystalline polyester resin having a hydroxy group is preferably from 5/1 to 1/1, more preferably from 4/1 to 1.2/1, and particularly preferably from 2.5/1 to 1.5/1. In a case of the crystalline resin precursor having another skeleton and/or terminal group, just the components are different, so that the ratio is the same.

There is no specific limit to the compounds such as the above-specified resin having an active hydrogen group and the above-specified cross-linking agent or elongation agent having an active hydrogen group and any compound having an active hydrogen group is suitably used. When the above-specified functional group reactive with an active hydrogen group is the isocyanate group, resins having a hydroxy group (alcoholic hydroxy group and phenolic hydroxy group), amino group, carboxylic group, mercapto group, etc. are suitable. Water and amines are particularly suitable in terms of the reaction speed.

There is no specific limitation to the amines. Specific examples thereof include, but are not limited to, phenylene diamine, diethyltoluene diamine, 4,4'-diamino diphenyl methane, 4,4'-diamino-3,3'-dimethyldicyclo hexylmethane, diamine cyclohexane, isophorone diamine, ethylene diamine, tetramethylene diamine, hexamethylene dimaine, diethylene triamine, triethylene tetramine, ethanol amine, hydroxyethyl aniline, aminoethyl mercaptan, aminopropyl meracaptan, amino propionic acid, and amino caproic acid. In addition, ketimine compounds and oxazolidine compounds in which these amino groups are blocked with ketones (acetone, methylethyl ketone, and methylisobutyl ketone) are also suitable.

Any binder resin that satisfies the conditions of the present disclosure can be used in the present disclosure. The crystalline resin and the non-crystalline resin can be used in combination.

There is no specific limit to the non-crystalline resin. Any resin having a non-crystalline property can be suitably used. Specific examples thereof include, but are not limited to, styrene mono-polymers and substituted styrene mono-polymers such as polystyrene and polyvinyltoluene; styrene copolymers such as styrene-methyl acrylate copolymers, styrene methacrylate copolymers, styrene-methyl methacrylate copolymers, styrene-acrylonitrile copolymers, styrene-vinyl methyl ether copolymers, styrene-vinyl methyl ketone copolymers, styrene-vinyl methyl ketone copolymers, styrene-butadiene copolymers, and styrene-maleic acid ester copolymers; other resins such as polymethyl methacrylate resins, polybutyl methacrylate resins, polyvinyl acetate resins, polyethylene resins, polyesters resins, polyurethane resins, epoxy resins, polyvinyl butyral resins, polyacrylic resins, rosin resins, modified rosin resins, and resins modified to have a functional group reactive with an active hydrogen group. These resins can be used alone or in combination.

Releasing Agent

The releasing agent contained in the toner of the present has two or more kinds of alkyl monoester compounds having different number of carbon atoms in a range of from 30 to 50 and the content of the component A in the two or more kinds of alkyl monoester compounds ranges from 30% by weight to less than 50% by weight based on the total weight of the releasing agent and, the component B, from 10% by weight to less than 50% by weight based on the total weight of the releasing agent. The content of the component A is more preferably from 40% by weight to less than 50% by weight and, the component B, from 30% by weight to less than 50% by weight.

The total weight of the releasing agent means the content of the releasing agent added to the toner, which may include a minute quantity of impurities such as alkyl monoester compounds having 29 or less carbon atoms or 51 or more carbon atoms, and mono-functional higher alcohol components and mono-functional higher carboxylic acid components deriving from the raw materials of the alkyl monoester compounds.

The absolute difference between the number of carbon atoms Na of the component A in the alkyl monoester compounds contained in the releasing agent described above and the number of carbon atoms Nb of the component B in the alkyl monoester compounds contained therein is preferably from 1 to 12 and more preferably from 2 to 6. When the absolute difference between Na and Nb is too large, the amount of the volatilized compound of the alkyl monoester compounds described above in a particular fixing temperature range tends to increase, thereby degrading the contamination in the machine, which is not preferable. In addition, since the fixing temperature in the machine is controlled within a certain temperature range (for example, a narrow temperature range within + or −10° C. of the preset temperature), if Na is by far smaller than Nb (e.g., Na—Nb<−12), the volatilized amount tends to furthermore increases, which is not preferable.

The total content of the component A and the component B in the alkyl monoester compounds contained in the releasing agent described above is preferably 90% by weight or more based on the total content of the releasing agent. Moreover, in addition to the component A and the component B, when the releasing agent contains a component C, which is an alkylmonoester compound having 30 to 50 carbon atoms which is different from those of the component A and the component B, it is preferable that the total content of the component A, the component B, and the component C is 95% or more based on the total content of the releasing agent. If the total content is outside the range, the releasing agent contains various kinds of components in different minute quantity, so that the fusion characteristics of the releasing agent is broad, which invites deterioration of the stability of the releasing agent and high-temperature stability, which is not preferable.

The total contents of alkyl monoester compounds having less than 30 carbon atoms contained in the releasing agent and the higher alcohol components and higher carboxylic acids mainly deriving from non-reacted raw materials of the alkyl monoester compounds is preferably 5% by weight or less and more preferably 3% by weight or less. When the total content of these components is too large, the melting point of the crystalline resin serving as the binder resin tends to drop, thereby degrading the high-temperature stability of the toner, which is not preferable.

In particular, since the higher alcohol components and higher carboxylic acids mainly deriving from non-reacted raw materials of the alkyl monoester compounds tend to lower the melting point of the crystalline resin significantly and degrade the high-temperature stability greatly, it is particularly preferable not to contain these.

Each of the two or more kinds of the alkyl monoester compounds contained in the releasing agent in a certain amount has a moderately different polarity depending on the number of carbon atoms in the alkyl groups in the molecule. Therefore, while one component of the alkylmonoester compounds is present close to the surface of the toner to secure the releasability at low temperatures and another component of the alkylmonoester compounds is present closer to the center of the toner and oozes when heated to a high temperature. Therefore, such a toner tends to cover a wide range of the fixing releasability. Also, since not all the releasing agent component is present on the toner surface, the releasing agent contaminates members (for example, carriers, charging members such as a charging blade) of the machine less.

Therefore, durable toner is obtained by using the releasing agent having the composition described in the present disclosure. Furthermore, the degree of the impact on the presence state of the releasing agent inside the toner by the polarity according to the number of carbon atoms in the alkyl group of the alkyl monoester compounds increases when manufacturing toner by emulsifying oil droplets in an aqueous medium and the alkyl monoester compounds having a small number of carbon atoms in the alkyl group in the molecule tends to be present closer to the toner surface.

The compound represented by the following Chemical Structure 1 is used as the alkyl ester compound described above.

$$Ra—COO—Rb$$

In the Chemical Structure 1, Ra represents an alkyl group having 14 to 30 carbon atoms and Rb represents 1 to 36 alkyl groups.

An alkyl monoester compound in which Ra is a straight chain alkyl group having 14 to 30 carbon atoms and Rb is a straight chain alkyl group having 16 to 36 carbon atoms is particularly preferable.

The alkyl monoester compound is synthesized by, for example, esterification of a mono-functional alcohol component and a mono-functional higher carboxylic component and more preferably from a mono-functional higher alcohol component and a mono-functional higher carboxylic component. These mono-functional higher alcohol component and mono-functional higher carboxylic component are typically obtained by natural products and are made of mixtures having an even number of carbon atoms. To obtain the alkyl monoester compounds, these mixtures can be esterified. However, by-products having structures similar to that of the target alkyl monoester compounds are produced, thereby easily having an adverse impact on each characteristic, in particular, the high-temperature stability, of the toner.

Consequently, it is preferable to preliminarily refine the mono-functional alcohol component and the mono-functional higher carboxylic component as the raw materials to improve the purity before esterification or separately refine products by solvent extraction or distillation under reduced pressure operation to obtain a highly pure alkyl monoester compound for use in the present disclosure, followed by mixing these alkyl monoester compounds to obtain the releasing agent of the present disclosure.

Specific examples of the mono-functional alcohol component include, but are not limited to, mono-functional straight-chain alcohols such as methanol, ethanol, 1-propanol, 1-butanol, 1-pentanol, 1-hexanol, 1-heptanol, 1-octanol, 1-nonanol, 1-decanol, 1-undecanol, 1-dodecanol, 1-trodecanol, myristyl alcohol, cetyl alcohol, stearyl alcohol, 1-eicosanol, behenyl alcohol, lignoceryl alcohol, ceryl alcohol, and 1-triacontanol.

Specific examples of the mono-functional carboxylic component include, but are not limited to, myristic acid, pentadecane acid, palmitic acid, stearic acid, arachidic acid, behenic acid, lignoceric acid, cerinic acid, montanic acid, and melissic acid.

There is no specific limit to the melting point of the releasing agent. The melting point is preferably from 50° C. to 90° C., more preferably from 55° C. to 80° C., and particularly preferably from 60° C. to 75° C. When the melting point of the releasing agent is too low, the high-temperature stability of the toner tends to deteriorate. In contrast, when the melting point is too high, a cold offset problem, i.e., an offset phenomenon that occurs at a low fixing temperature, tends to occur.

The melting point of the releasing agent can be measured by a differential scanning calorimeter (for example, TA-60WS or DSC-60, manufactured by Shimadzu Corporation). That is, place 5.0 mg of the releasing agent in an aluminum sample container, set the sample container on a holder unit, and set them in an electric furnace. Next, raise the temperature in nitrogen atmosphere from 0° C. to 150° C. at a temperature rising speed of 10° C./min. Thereafter, drop the temperature from 150° C. to 0° C. at a temperature falling speed of 10° C./min. Then, raise the temperature in nitrogen atmosphere from 0° C. to 150° C. at a temperature rising speed of 10° C./min. again to plot a differential scanning calorimetry (DSC) curve.

Using an analysis program installed in the DSC-60 system, determine the maximum peak temperature of the melting heat during the second temperature rising as the melting point from the obtained DSC curve.

The releasing agent preferably has a melt viscosity of from 5 mPa·sec to 20 mPa·sec and more preferably from 5 mPa·sec to 10 mPa·sec. When the melt viscosity is too small, the releasability tends to deteriorate. When the melt viscosity is too large, the dispersibility of the releasing agent in the toner tends to deteriorate, thereby degrading the hot offset resistance and the releasability at low temperatures, which is not preferable. The melt viscosity is measured by a Brookfield type rotatory viscometer.

The releasing agent preferably has an acid value of from 0.1 mgKOH/g to 10 mgKOH/g and more preferably from 0.1 mgKOH/g to 5 mgKOH/g in terms of the dispersibility and the hot offset resistance of the releasing agent. When the acid value is too small, the dispersibility of the releasing agent in the toner tends to deteriorate, thereby degrading the hot offset resistance and the releasability at low temperatures, which is not preferable. In addition, when the acid value is too large, the releasing agent tends to transfer to an aqueous medium when emulsifying and/or dispersing toner liquid material (oil phase) in the aqueous medium (aqueous phase), so that the content of the releasing agent in the toner is short, which may cause degradation of the hot offset resistance of the toner.

Furthermore, since the releasing agent is eccentrically-located on the surface of the toner, a minor quantity of cold offset tends to occur during fixing or the toner tends to agglomerate under stress by stirring in the development device, thereby degrading the image quality, which is not preferable.

The acid value can be measured by using an automatic potentiometric titrator (DL-53, Titrator, manufactured by METTLER TOLEDO INTERNATIONAL INC.), electrodes (DG 113-SC, manufactured by METTLER TOLEDO INTERNATIONAL INC.), and an analyzing software (LabX Light Version 1.00.000). The device is calibrated by using a liquid mixture of 120 ml of toluene and 30 ml of ethanol under the following measuring conditions at 23° C.

Measuring Conditions
Stir
Speed [%]: 25
Time {s]: 15
EQP titration
Titrant/Sensor
Titrant: $CH_3ONa$
Concentration [mol/L]: 0.1
Sensor: DG115
Unit of measurement: mV
Predispensing to volume
Volume [mL]: 1.0
Wait time {s]: 0
Titrant addition Dynamic
dE (snt) [mv]: 8.0
dV (min) [mL]: 0.03
dV (max) [mL]: 0.5
Measure mode: Equilibrium controlled
dE [mV]: 0.5
dt [s]: 1.0
t (min) [s]: 2.0
t (max) [s]: 20.0
Recognition
Threshold: 100.0
Steepest jump only: No
Range: No
Tendency: None
Termination
at maximum volume [mL]: 10.0
at potential: No
at slope: No
after number: EQPs Yes
n=1
comb. termination conditions: No
Evaluation
Procedure: Standard
Potential 1: No
Potential 2: No
Stop for reevaluation: No Specific measuring is conducted according to the method described in JIS K0070-1992 as follows: Add and dissolve 0.5 g of a sample to 120 ml of toluene by stirring at room temperature (23° C.) for about 10 hours; and add 30 ml of ethanol thereto to obtain a sample solution. Next, titrate the sample solution with a preliminarily standardized alcohol solution of 0.1 N potassium hydroxide to obtain an amount [ml] of titration. Calculate the acid value by assigning the amount to the following expression:

$$\text{Acid value:} X \times N \times 56.1/\text{sample mass(mgKOH/g)}$$

In the expression, N is a factor of the alcohol solution of 0.1 N potassium hydroxide.

The dispersion diameter (particle diameter along the maximum direction) of the releasing agent in the toner is preferably from 0.10 μm to 0.80 μm and more preferably from 0.15 μm to 0.30 μm. When the dispersion diameter of the releasing agent in the toner is too large, the content of the releasing agent varies among the toner particles so that the releasability of the toner or the particle size distribution of the toner deteriorates and in addition, the releasing agent easily exposes to the surface of the toner, causing filming of the releasing agent on the development device and the carrier, which is not preferable.

Furthermore, when the dispersion diameter of the releasing agent in the toner is too small, the ratio of the releasing agent present in the toner tends to increase (i.e., relatively the ratio of the releasing agent present closer to the toner surface decreases), thereby degrading the releasability, which is not preferable.

There is no specific limit to the measuring method of the dispersion diameter of the releasing agent. For example, it can be measured by the following method. First, embed the toner in an epoxy resin to make an ultra thin strip of about 100 nm followed by dying by ruthenium tetroxide. Next, observe the strip with a magnifying power of 10,000 using a transmission electron microscope (TEM) and evaluate a photograph taken thereby.

Consequently, observe the dispersion state of the releasing agent to measure the dispersion diameter.

There is no specific limit to the content of the releasing agent in the toner. For example, the content is preferably from 1% by weight to 20% by weight and more preferably from 3% by weight to 10% by weight. When the content is too small, the hot offset resistance tends to deteriorate and when the content is too large, the high-temperature stability, the chargeability, the transferability, and the stress-resistance tend to deteriorate, which is not preferable.

The releasing agent in the present disclosure contains the two or more kinds of alkyl monoester compounds described above as the main components and optionally may contain other typical releasing agents such as paraffin if they secure the releasing stability, the high-temperature stability, and the suppression of the contamination in the machine.

Coloring Agent

There is no specific limit to the coloring agent for use in the toner of the present disclosure and any known coloring agent can be selected for use.

There is no specific limit to the color of the coloring agent for use in the toner of the present disclosure. One or more can be selected from black toner, cyan toner, magenta toner, and yellow toner and various kinds of colors can be obtained by selecting the coloring agents. The color toner is preferable.

Specific examples of the black color toner include, but are not limited to, carbon black (C.I. Pigment Black 7) such as furnace black, lamp black, acetylene black, and channel black, metals such as copper, iron (C.I. Pigment Black 11), and titanium oxides, and organic pigments such as aniline black (C.I. Pigment Black 1).

Specific examples of the pigments for magenta include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, 269; C.I. Pigment Violet 19; C.I. Vat Red 1, 2, 10, 13, 15, 23, 29, and 35.

Specific examples of the pigments for magenta include, but are not limited to, C.I. Pigment Blue 2, 3, 15, 15:1, 15:2, 15:3, 15:4, 15:6, 16, 17, 60; C.I. Vat Blue 6; C.I. Acid Blue 45; Copper phthalocyanine pigments in which one to five phthal imidemethyl groups are substituted in the phthalocyanine skeleton; and Green 7 and Green 36.

Specific examples of the pigments for yellow include, but are not limited to, C.I. Pigment Yellow 12, 3, 4, 5, 6, 7, 10, 11, 12, 13, 14, 15, 16, 17, 23, 55, 65, 73, 74, 83, 97, 110, 139, 151, 154, 155, 180; C.I. Vat Yellow 1, 3, and 20; and Orange 36.

The content of the coloring agent in the toner is preferably from 1% by weight to 15% by weight and more preferably from 3% by weight to 10% by weight. When the content of the coloring agent is too small, the coloring performance of the toner tends to deteriorate. To the contrary, when the content of the coloring agent is too great, dispersion of the pigment in the toner tends to be insufficient, thereby degrading the coloring performance and the electric characteristics of the toner.

The coloring agent and the resin can be used in combination as a master batch. There is no specific limit to such resins. In terms of the compatibility with the binder resin in the present disclosure, using the binder resin for use in the present disclosure or resins having a structure similar thereto is preferable.

The master batch can be manufactured by applying a high shearing force to the resin and the coloring agent for mixing and/or kneading. In this case, an organic solvent can be used to boost the interaction between the coloring agent and the resin. In addition, so-called flushing methods are advantageous in that there is no need to drying because a wet cake of the coloring agent can be used as they are. The flushing method is a method in which a water paste containing water of a coloring agent is mixed or kneaded with an organic solvent and the coloring agent is transferred to the resin side to remove water and the organic solvent. High shearing dispersion devices such as a three-roll mill, etc. can be used for mixing or kneading.

Charge Control Agent

In addition, to impart a suitable charging power to the toner, it is possible to optionally contain a charge control agent.

Any known charge control agent is suitably usable. However, colorless or white materials are preferable because color materials may have an impact on the coloring.

Specific examples of the charge control agent include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and metal salts of salicylic acid derivatives. These can be used alone or in combination.

The content of the charge control agent is determined depending on the kinds of the binder resin and the toner manufacturing method (including the dispersion method) and therefore is not unambiguously defined. However, the content of the charge control agent is preferably from 0.01% by weight to 5% by weight and more preferably from 0.02% by weight to 2% by weight based on the binder resin. When the addition amount is too large, the toner tends to have an excessively large size of charge, which reduces the effect of the charge control agent. Therefore, the electrostatic attraction force between the developing roller and the toner increases, resulting in deterioration of the fluidity of the development agent and insufficient charge starting property and size of charge, which may have an adverse impact on the toner images.

External Additive

In the toner of the present disclosure, it is possible to add external additives to reform the fluidity and adjust the size of charge and the electric characteristics. There is no specific limit to the external additives and any known external additives is suitably usable. Specific examples thereof include, but are not limited to, silica particulates, hydrophpobized silica particulates, aliphatic acid metal salts (such as zinc stearate and aluminum stearate); metal oxides (such as titania, alumina, tin oxide, antimony oxide) and hydrophobized compounds thereof, and fluoropolymers. Among these, hydrorphobized silica particulates, titania particles, and hydrophobized titania particulates are preferable.

Specific examples of the hydrophobized silica particles include, but are not limited to, HDK H 2000, HDK H 2000/4, HDK H 2050 EP, HVK21, HDK H 1303, (all manufactured by HOECHST AG), R972, R974, RX 200, RY200, R202, R805, and R812 (manufactured by NIPPON AEROSIL CO., LTD.).

In addition, specific examples of the titania particulates include, but are not limited to, P-25 (manufactured by NIPPON AEROSIL CO., LTD.), STT-30 and STT-65C-S (manufactured by TITAN KOGYO, LTD.), TAF-140 (manufactured by FUJI TITANIUM INDUSTRY CO., LTD.), and MT-150W, MT-500B, MT-600B, and MT-150A (manufactured by TAYCA CORPORATION). Specific examples of the hydrophobized titan oxide particulates include, but are not limited to, T-805 (manufactured by NIPPON AEROSIL CO., LTD.); STT-30A and STT-65S-S (manufactured by TITAN KOGYO, LTD.); TAF-500T and TAF-1500T (manufactured by FUJI TITANIUM INDUSTRY CO., LTD.); MT-100S and MT-100T (manufactured by TAYCA CORPORATION); and IT-S (manufactured by ISHIHARA SANGYO KAISHA LTD.).

The hydrophobized silica particulates, the hydrophobized titania particulates, and the hydrophobized alumina particulates can be obtained by treating hydrophillic particulates with a silane coupling agent such as methyl trimethoxyxilane, methyltriethoxy silane, and octyl trimethoxysilane. Specific examples of hydrophobizing agents include, but are not limited to, silane coupling agents such as dialkyl dihalogenated silane, trialkyl halogenized silane, alkyl trihalogenized silane, and hexa alkyl disilazane; silylating agents, silane coupling agents having an alkyl fluoride group, organic titanate coupling agents, aluminum-containing coupling agents, silicone oil, and silicone varnish.

The inorganic particulate preferably has an average primary particle diameter of from 1 nm to 100 nm and more preferably from 3 nm to 70 nm. When the average particle diameter is too small, the organic particulates are buried in the toner, so that its features are not suitably demonstrated. When the average particle diameter is too large, the surface of the image bearing member may be damaged unevenly.

Inorganic particulates and hydrophobized inorganic particulates can be used in combination as the external additives. It is more preferable that the external additives contain two or more kinds of inorganic particulates having an average primary particle diameter of 20 nm or less and one or more kinds of inorganic particulates having an average primary particle diameter of 30 nm or more. In addition, the specific surface area of such inorganic particulates as measured by the BET method is preferably from 20 $m^2/g$ to 500 $m^2/g$.

The content of the external additive is preferably from 0.1% by weight to 5% by weight and more preferably from 0.3% by weight to 3% by weight based on the toner.

Resin particulates can be added as the external additives. Specific examples thereof include, but are not limited to, polystyrene prepared by a soap-free emulsion polymerization method, a suspension polymerization method, or a dispersion polymerization method; and copolymers of methacrylic acid esters and acrylic acid esters; polycondensation resins such as silicone resins, benzoguanamine resins, and nylon resins, and polymerized particles by a thermocuring resin. By a combinational use of such resin particulates, the chargeability of the toner is improved, thereby reducing the reversely charged toner, resulting in a decrease in background fouling. The content of the resin particulates is preferably from 0.01% by weight to 5% by weight and more preferably from 0.1% by weight to 2% by weight, based on the toner.

Method of Manufacturing Toner

There is no specific limit to any method of manufacturing the toner of the present disclosure and any material thereof that satisfy the conditions. For example, a mixing, kneading, and pulverizing method and a method of granulating toner particles in an aqueous medium, so called chemical manufacturing methods, are suitably used.

Specific examples of the chemical manufacturing method include, but are not limited to, a suspension polymerization method, an emulsification polymerization method, a seed polymerization method, and a dispersion polymerization method that manufacture a toner using a monomer as the initial material; a dissolution suspension method of dissolving a resin precursor and a resin followed by dispersion and/or emulsification in an aqueous medium; a method of emulsifying and/or dispersing an oil phase composition containing a resin precursor (prepolymer containing a reactive group) having a functional group reactive with an active hydrogen group in an aqueous medium containing resin particulates to react a compound having an active hydrogen group with the prepolymer having a reactive group in the dissolution suspension method (manufacturing method I); a phase change emulsification method of adding water to a solution containing a resin, a resin precursor, and a suitable emulsifier; and an agglomeration method of granulating the resin particles obtained by these methods, which are dispersed in the aqueous medium, followed by heating, melting, etc. to obtain particles having a desired size. Among these, the toner obtained by the dissolution suspension method, the manufacturing method I, and the agglomeration method is preferable in light of the granularity (easiness of controlling the particle size distribution, controlling of particle forms, etc.) of the crystalline resin. The toner obtained by the manufacturing method I is more preferable.

These manufacturing methods are described in detail below.

In the mixing, kneading, and pulverizing method, for example, a toner material containing at least a coloring agent, a binder resin, and a releasing agent is melted and mixed and kneaded, and thereafter pulverized and classified to manufacture mother particles of the toner described above.

In the melting, mixing, and kneading, the toner material are mixed and placed in a melting, mixing and kneading machine for melting, mixing, and kneading. Single-screw or twin-screw continuous mixing and kneading machines or batch type mixing and kneading machines by a roll mill can be used as the melting and mixing and kneading machine. Specific examples thereof include, but are not limited to, KTK type twin-screw extruders (manufactured by KOBE STEEL, LTD.), TEM type extruders (manufactured by TOSHIBA MACHINE CO., LTD), twin-screw extruders (manufactured by KCK), PCM type twin-screw extruders (manufactured by Ikegai Corp.), and Ko-kneaders (manufactured by Buss). This melting and mixing and kneading are required to be conducted under suitable conditions not to sever the molecular chain of the binder resins. To be specific, the temperature in the melting and mixing and kneading operation is determined referring to the softening point of the binder resin. When the temperature is too high relative to the softening point, the molecular chain tends to be severely severed. When the temperature is too high relative to the softening point, dispersion tends not to proceed smoothly.

In the pulverization process, the mixture obtained in the mixing and kneading is pulverized. In the pulverization process, it is preferable to coarsely pulverize the mixed and kneaded materials first followed by fine pulverization. In this process, kneaded mixtures are pulverized by collision with a collision board in a jet stream, collision between particles in a jet stream, and pulverization at narrow gaps between a stator and a rotor that is mechanically rotating, etc.

The classification process adjusts the pulverized material obtained in the pulverization process by classification to have a predetermined particle diameter. The classification can be performed by removing particulate portions using a cyclone, a decanter, or a centrifugal.

After the pulverization and classification, the pulverized material is classified into an air stream by centrifugal, etc. to manufacture mother toner particles having a predetermined particle diameter.

In the dissolution suspension method, for example, mother particles of the toner are manufactured by dispersing and/or emulsifying an oil phase composition in which a toner composition having at least a binder resin, a binder resin precursor, a coloring agent, and a releasing agent is dissolved and/or dispersed in an organic solvent in an aqueous medium.

The organic solvent to dissolve or disperse the toner composition is preferably volatile with a boiling point lower than 100° C. in order to easily remove the organic solvent later.

Specific examples of the organic solvents include, but are not limited to, ester- or ester ether-based solvents such as ethyl acetate, butyl acetate, methoxy acetate, methyl cellosolve acetate, and ethyl cellosolve acetate; ether based solvents such as diethyl ether, tetrahydrofuran, dioxane, ethyl cellosolvem butyl cellosolve, and propylene glycol monomethyl ether; ketone-based solvents such as acetone, methyl ethylketone, methyl isobutyl ketone, di-n-butyl ketone, and cyclohexanone; alcohol-based solvents such as methanol, ethanol, n-propanol, isopropanol, n-butanol, isobutanol, t-butanol, 2-ethylhexyl alcohol, and benzyl alcohol; and mixtures thereof.

In the dissolution suspension method, it is possible to optionally use an emulsifier and a dispersant when dispersing and/or emulsifying the oil composition in the aqueous medium.

Any known surface active agent and hydrosoluble polymer can be used as the emulsifier and the dispersant. There is no specific limit to the surface active agent. Specific examples thereof include, but are not limited to, anion surface active agents (e.g., alkyl benzene sulphonic acid, and phosphoric acid esters), cationic surface active agents (e.g., quaternary ammonium salt type and amine salt type), amopholic surface active agents (e.g., carboxylic acid salt type, sulfuric acid ester salt type, sulphonic acid salt type, and phosphoric acid ester salt type), and non-ion surface active agents (e.g., AO addition type and polyol type). These surface active agents can be used alone or in combination.

Specific examples of the hydrosoluble polymers include, but are not limited to, cellulose-based compounds (e.g., methyl cellulose, ethyl cellulose, hydroxyethyl cellulose, ethyl hydroxyethyl cellulose, carboxy methyl cellulose, hydroxypropyl cellulose, and saponified compounds thereof; gelatine, starch, dextrine, gum arabic, chitin, chitosan, polyviny alcohol, polyvinyl pyrrolidone, polyethylene glycol, polyethylene imine, polyacryl amide, acrylic acid (salt) containing polymers (e.g., neutralized compounds of sodium hydroxide portion of polyacrylic acid sodium, polyacrylic acid potassium, polyacrylic acid ammonium, and polyacrylic acid, and copolymers of acrylic acid sodium and acrylic acid ester), neutralized compounds of sodium hydroxide portion of a copolymer of styrene and maleic anhydride, hydrosoluble polyurethane (reaction products of polyethylene glycol, polycaprolactone diol, etc. with polyisocyanate).

In addition, the organic solvents mentioned above and plasticizers can be used in combination as a helping agent for emulsification or dispersion.

It is preferable to obtain the toner of the present disclosure by agglomerating the mother toner particles of the toner by a method of emulsifying and/or dispersing an oil phase composition containing at least a binder resin, a resin precursor (prepolymer containing a reactive group) having a functional group reactive with an active hydrogen group, a coloring agent, and a releasing agent in an aqueous medium containing resin particulates to react a compound having an active hydrogen group contained in the oil phase composition and/or aqueous medium with the prepolymer having a reactive group in the dissolution suspension method (manufacturing method I).

Resin particulates can be formed through a known polymerization method. It is preferred to obtain an aqueous liquid dispersion of the resin particulates. For example, as the method of preparing an aqueous liquid dispersion of the resin particulates, the following methods of (a) to (h) can be used.

(a) A method of manufacturing an aqueous liquid dispersion of resin particulates directly from the polymerization reaction by a suspension polymerization method, an emulsification polymerization method, a seed polymerization method, or a dispersion polymerization method using a vinyl monomer as the initial material of the resin particulates.

(b) A method of manufacturing an aqueous liquid dispersion of resin particulates by: dispersing a precursor (monomer, oligomer, etc.) of a polyaddition- or polycondensation-based resin such as a polyester resin, a polyurethane resin, and an epoxy resin or its solvent solution under the presence of a suitable dispersion agent; curing the liquid dispersion by heating or addition of a curing agent.

(c) A method of manufacturing an aqueous liquid dispersion of resin particulates by dissolving a suitable emulsifier in a precursor (monomer, oligomer, etc.) of a polyaddition- or polycondensation-based resin such as a polyester resin, a polyurethane resin, and an epoxy resin or its solvent solution (Preferably liquid. Possibly using heat for liquefaction) followed by addition of water for phase change emulsification.

(d) A method of manufacturing an aqueous liquid dispersion of resin particulates by: fine-pulverizing resins preliminarily manufactured by a polymer reaction (addition polymerization, ring scission polymerization, polyaddition, addition condensation, polycondensation, etc.) with a fine grinding mill of a mechanical rotation type, jet type, etc.; classifying the resultant to obtain resin particulates; and dispersing the obtained resin particulates in water under the presence of a suitable dispersion agent.

(e) A method of manufacturing an aqueous liquid dispersion of resin particulates by: spraying in a form of a fine liquid mist a resin solution in which resins preliminarily synthesized by polymer reaction (addition polymerization, ring scission polymerization, polyaddition, addition condensation, polycondensation, etc.) are dissolved in a solvent to form resin particulates; and dispersing the obtained resin particulates in water under the presence of a suitable dispersion agent.

(f) A method of manufacturing an aqueous liquid dispersion of resin particulates by: precipitating resin particulates by adding a poor solvent to a resin solution in which resins preliminarily manufactured by a polymer reaction (addition polymerization, ring scission polymerization, polyaddition, addition condensation, polycondensation, etc.) are dissolved in another solvent or cooling down the resin solution preliminarily prepared by heating and dissolving in a solvent; removing the solvent to obtain resin particulates; and dispersing the obtained resin particulates in water under the presence of a suitable dispersion agent.

(g) A method of manufacturing an aqueous liquid dispersion of resin particulates by: dispersing in an aqueous medium a resin solution in which resins preliminarily manufactured by a polymer reaction (addition polymerization, ring scission polymerization, polyaddition, addition condensation, polycondensation, etc.) are dissolved in a solvent under the presence of a suitable dispersion agent; and removing the solvent by heating, reducing pressure, etc.

(h) A method of manufacturing an aqueous liquid dispersion of resin particulates by: dissolving a suitable emulsification agent in a resin solution in which resins preliminarily synthesized by a polymer reaction (addition polymerization, ring scission polymerization, polyaddition, addition condensation, polycondensation, etc.) are dissolved in a solvent; and adding water for phase change emulsification.

The resin particulate preferably has a volume average particle diameter of from 10 nm to 300 nm and more preferably from 30 nm to 120 nm. When the volume average particle diameter of the resin particulate is too small or large, the particle size distribution of the toner tends to deteriorate, which is not preferable.

The concentration of the solid portion of the oil phase is preferably from about 40% to about 80%. A concentration that is too high tends to make dissolution or dispersion difficult and also the viscosity becomes high, so that handling the solution or the liquid dispersion is difficult. A concentration that is too low results in deterioration in manufacturability of the toner.

Toner compositions other than the coloring agent and binder resins such as the releasing agent and a master batch of the toner compositions may be separately dissolved or dispersed in an organic solvent and thereafter mixed with the binder resin solution or liquid dispersion described above.

The aqueous medium is not limited to simple water. Mixtures of water with a solvent which can be mixed with water are also suitably usable. Specific examples of such a mixable solvent include, but are not limited to, alcohols (e.g., methanol, isopropanol, and ethylene glycol), dimethylformamide, tetrahydrofuran, cellosolves (e.g., methyl cellosolve), lower ketones (e.g., acetone and methyl ethyl ketone), etc.

There is no particular limit to the method of the emulsification and dispersion in the aqueous medium. Known facilities employing a low speed shearing method, a high speed shearing method, a friction method, a high-pressure jet method, an ultrasonic methods etc., can be used. Among these, the high speed shearing method is preferable in terms of size reduction of particles. When a high speed shearing type dispersion machine is used, there is no particular limitation to the rotation speed thereof. The rotation speed is typically from 1,000 rpm to 30,000 rpm, and preferably from 5,000 rpm to 20,000 rpm. The temperature during the dispersion process is typically from 0° C. to 150° C. (under pressure) and preferably from 20° C. to 80° C.

In order to remove the organic solvent from the thus prepared emulsion dispersion body, there is no specific limit to the removing method and any known method is suitable. For example, it is possible to employ a method of gradually raising the temperature of the emulsion dispersion body while stirring the system to completely evaporate and remove the organic solvent in the droplets.

Known technologies are used in the process of washing and drying mother toner particles dispersed in the aqueous medium. That is, after separation solid from liquid by a centrifugal or a filter press to obtain a toner cake, the obtained cake is re-dispersed in de-ionized water at room temperature to about 40° C. Subsequent to optional pH adjustment by an acid or an alkali, the resultant is subject to the solid and liquid separation treatment again. This process is repeated several times to remove impurities and the surface active agent. Thereafter, the resultant is dried by an air stream drier, a circulation drier, a reduced pressure drier, a vibration flow drier, etc. to obtain toner powder. Toner particulate components can be removed by a centrifugal and a known classifier can be optionally used after the drying process to obtain a toner having a desired particle size distribution.

In the agglomeration method, for example, the mother particles of the toner is manufactured by mixing a liquid dispersion of resin particulates containing a binder resin, a liquid dispersion of coloring agent particles, and optionally a liquid dispersion of releasing agent particulates for agglomeration.

The liquid dispersion of resin particulates can be obtained by a known method using, for example, an emulsification polymerization, a seed polymerization, and a phase change emulsification. The liquid dispersion of coloring agent particles and the liquid dispersion of releasing agent particulates are obtained by a known wet dispersion method of dispersing a coloring agent or a releasing agent in an aqueous medium.

To control the agglomeration state, a method of heating, addition of a metal salt, pH adjustment, etc. is preferably used.

There is no specific limit to the metal salt. Specific examples of the monovalent metal forming the metal salt include, but are not limited to, sodium and potassium. Specific examples of the divalent metal forming the metal salt include, but are not limited to, calcium and magnesium. A specific example of the trivalent metal forming the salt is aluminum Specific examples of anions that form the salts include, but are not limited to, chloride ion, bromide ion, iodine ion, carbonate ion, and sulfuric acid ion. Among these, magnesium chloride, aluminum chloride, and complexes and polymers thereof are preferable. In addition, it is possible to accelerate fusion of resin particles by heating during or after agglomeration, which is preferable in terms of uniformity of the toner. Furthermore, it is possible to control the form of toner by heating. As the toner is heated more and more, the toner form becomes closer to a sphere.

The methods described above are used for the process of washing and drying the mother toner particles dispersed in the aqueous medium.

Furthermore, inorganic particulates such as hydrophobic silica fine powder may be added to the thus-manufactured mother toner particles to improve the fluidity, the preservability, the development property, and the transfer property.

Although the additive is mixed by a typical powder mixer, a mixer having a jacket, etc. is preferable to adjust the internal temperature. To change the history of the load applied to the external additive, adding the additive in the midstream or little by little during mixing is suitable. It is also suitable to change the number of rotations, rolling speed, time, temperature, etc. of the mixer. Heavy load followed by relatively light load or vice versa is applicable. Specific examples of the mixers include, but are not limited to, V-type mixers, Rocking mixers, Lodige mixers, Nautor mixers, and Henschel mixers. Next, filtrate the mixture with a screen having 250 meshes or more to remove coarse particles and agglomerated particles to obtain toner.

There is no specific limit to the size and form of toner. It is preferable that the toner has the following average circularity, volume average particle diameter, the ratio (volume average particle diameter to number average particle diameter) of the volume average particle diameter to the number average particle diameter.

The average circularity is a value obtained by dividing the circumference of a circle corresponding to the projection area of the toner form by the circumference of the toner particle and is preferably from 0.950 to 0.980 and more preferably from 0.960 to 0.975. It is preferable that toner includes particles having an average circularity less than 0.95 in an amount of 15% or less.

When the average circularity is too small, e.g., less than 0.950, images having insufficient transferability without dust tend to be produced. When the average circularity is too large, for example, greater than 0.980, the cleaning performance for the image bearing member and the transfer belt becomes poor in an image forming system employing a blade cleaning system, which results in contamination on images, for example, background fouling caused by toner remaining on the image bearing member as a result of non-transferred toner ascribable to sheet feeding problems, etc. when forming images having a high image area ratio such as photographs or contamination on the charging roller to charge the image bearing member by contact, thereby inhibiting exhibition of the original charging capability.

The average circularity is calculated by measuring toner particles by a flow type particle image analyzer (FPIA-2100, manufactured by Sysmex Corporation) followed by analysis using an analysis software (FPIA-2100 Data Processing Program for FPIA version 00-10). To be specific, 0.1 ml to 0.5 ml of 10% by weight surface active agent (alkylbenzene sulfonate, NEOGEN SC-A, manufactured by DAIICHI KOGYO CO., LTD.) is placed in a glass beaker (100 ml). 0.5 g of each toner is added in the beaker and stirred by a microspatula. 80 ml of deionized water is added to the mixture. The thus-obtained liquid dispersion is subject to dispersion treatment by an ultrasonic wave dispersion device (manufactured by Honda Electronics). The toner form and distribution are measured for the liquid dispersion using FPIA-2100 until the concentration is 5,000 particles/μl to 15,000 particles/μl.

In this measuring method, it is suitable to make the concentration of the liquid dispersion is 5,000 particles/μl to 15,000 particles/μl in terms of the measuring reproducibility of the average circularity. To obtain the concentration of the liquid dispersion, it is required to change the liquid dispersion, that is, the amount of the surface active agent to be added and the amount of toner. The required amount of the surface active agent varies depending on the hydrophobicity of the toner as in the measuring the toner particle diameter. If an excessively large amount is added, the noise tends to occur. If an excessively small amount is added, the toner tends to be insufficiently wet, resulting in insufficient dispersion. In addition, the addition amount of the toner depends on the particle diameter. In a case of a small particle diameter, the amount tends to be small and, a large particle diameter, large. When the toner particle diameter is from 3 μm to 10 μm, the addition amount of the toner is 0.1 g to 0.5 g, thereby adjusting the concentration of the liquid dispersion to be 5,000 particles/μl to 15,000 particles/μl.

There is no specific limit to the volume average particle diameter of the toner. For example, the toner preferably has a volume average particle diameter of from 3 μm to 10 μm and more preferably from 4 μm to 7 μm. When the volume average particle diameter is too small, toner tends to adhere to the surface of the carrier while stirring in the development device over an extended period of time, thereby degrading the charging power of the carrier in a case of a two component development agent. When the volume average particle diameter is too large, it tends to be difficult to produce quality images with high definition and the particle diameter of the toner tends to vary significantly when replenishing the toner in the development agent.

The ratio (volume average particle diameter to number average particle diameter) of the volume average particle diameter to the number average particle diameter in the toner is preferably from 1.00 to 1.25 and more preferably from 1.00 to 1.15.

The volume average particle diameter, the number average particle diameter, and the ratio (volume average particle diameter to number average particle diameter) are measured by using particle size measuring instrument (MULTISIZER III, manufactured by BECKMAN COULTER INC.) with an aperture diameter of 100 μm and analyzed by an analysis software (BECKMAN COULTER MULTISIZER 3 VERSION 3.51). To be specific, 0.5 ml of 10% by weight surface active agent (alkylbenzene sulfonate, NEOGEN SC-A, manufactured by Daiichi Kogyo Co., Ltd.) is placed in a glass beaker (100 ml). 0.5 g of each toner is added in the beaker and stirred by a microspatula. 80 ml of deionized water is added to the mixture. The thus-obtained liquid dispersion is subject to dispersion treatment for ten minutes by an ultrasonic wave dispersion device (W-113MK-II, manufactured by Honda Electronics). The liquid dispersion is measured by using the MULTISIZER III using ISOTON® III (manufactured by BECKMAN COULTER INC.) as the measuring solution. The liquid dispersion is dripped such that the concentration indicated by the measuring device is from 6 to 10%. In this measuring method, it is desired to keep the density in the range mentioned above in terms of measuring reproducibility. The measured particle diameter does not have an error when the density is in that range.

The ratio (Tsh2nd/Tsh1st) of the shoulder temperature Tsh1st of the melting heat peak at the first temperature raising by a differential scanning calorimeter (DSC) of the toner to the shoulder temperature Tsh2nd of melting heat peak at the second temperature raising is preferably from 0.90 to 1.10.

The shoulder temperatures (Tsh2nd and Tsh1st) of the melting heat peaks of the toner can be measured by a differential scanning calorimeter (DSC) (for example, TA-60W and DSC-60, manufactured by SHIMADZU CORPORATION) as follows: That is, place 5.0 mg of the toner in an aluminum sample container, set the sample container on a holder unit, and set them in an electric furnace. Next, raise the temperature in nitrogen atmosphere from 0° C. to 150° C. at a temperature rising speed of 10° C./min. Thereafter, drop the temperature from 150° C. to 0° C. at a temperature falling speed of 10° C./min. Then, raise the temperature in nitrogen atmosphere from 0° C. to 150° C. at a temperature rising speed of 10° C./min. again to plot a differential scanning calorimetry (DSC) curve In the thus-obtained DSC curve, the endotherm peak temperature at the first temperature raising is Tm1st and, the second, Tm2nd. Select the maximum if there are multiple endotherm peaks. With regard to respective endotherm peaks, define the intersections of the base line on the lower temperatures from the endotherm peak and the tangent on the slope on the lower temperature side forming the endotherm peak.

With regard to the viscoelasticity of the toner, the storage elastic modulus G' (70) at 70° C. is preferably from $5.0\times10^4$ Pa to $5.0\times10^5$ Pa. With regard to the viscoelasticity of the toner, the storage elastic modulus G' (160) at 160° C. is preferably from $1.0\times10^3$ Pa to $1.0\times10^4$ Pa.

When the G' (70) is too small, the image strength immediately after fixing tend to deteriorate, thereby causing damage on the surface of the image, which is not preferable. When the G' (70) is too large, the melting and fusion of the toner during the low-temperature fixing, causing deterioration of the low-temperature fixability, which is not preferable. When the G' (160) is too small, the hot offset resistance tends to deteriorate, which is not preferable. When the G' (160) is too large, the image gloss tends to deteriorate, which is not preferable.

The storage elastic modulus G' of the toner can be measured by a dynamic viscoelasticity measuring device (for example, ARES, manufactured by TA INSTRUMENT JAPAN INC.). Mold a sample to a pellet having a diameter of 8 mm and a thickness of from 1 mm to 2 mm; Fix the pellet to a parallel plate having a diameter of 8 mm; Stabilize it at 40° C.; and heat it at a frequency of 1 Hz (6.28 rad/s) with a distortion amount (distortion amount control mode) of 0.1% to 200° C. at a temperature rising speed of 2.0° C./min. for measurement.

The crystallinity of the toner of the present disclosure is preferably 10% or more, more preferably from 15% to 30%, and particularly preferably from 20% to 25%. When the content of the crystalline resin in the entire binder resin is too small, for example, less than 50% or less, and if the crystallinity is too small, for example, 10% or less, the melting point of the non-crystalline resin tends to have a greater impact on the high-temperature stability of the toner than the melting point of the crystalline resin. As a result, the crystalline resin tends to demonstrate a plasticizing effect on the non-crystalline resin, thereby degrading the high-temperature stability of the toner significantly, which is not preferable. In addition, when the crystallinity is 15% or more, the impact of the non-crystalline portion contained in the toner does not increase, so that the drastic response to the viscoelasticity against heat, which is inherent to the crystalline resin, is maintained. Therefore, the low-temperature fixability and the high-temperature stability do not deteriorate.

On the other hand, when the value of the crystallinity is too great, the reduction of the hardness ascribable to the crystalline resin is not easily suppressed, which leads to carrier filming caused by stirring stress in the development device over an extended period of time and production of agglomerated particles, resulting in defective images, which is not preferable.

It is possible to control the crystallinity of the toner by, for example, changing the mixing ratio of the crystalline resin and the non-crystalline resin or changing the crystallinity of the crystalline resin (e.g., changing the monomer compositions or the ratio of the crystalline portion to the non-crystalline portion of the block resin having a crystalline portion and a non-crystalline portion).

The crystallinity of the toner and the resin in the present disclosure is an area ratio of the main diffraction peak to the halo in the diffraction profile obtained by the X ray diffraction measuring. The calculation method of the X ray diffraction measuring and the crystallinity are described below.

The X ray diffraction measuring of the toner and the resin is conducted by two-dimensional detector installed X-ray diffraction instrument (D8 DISCOVER with GADS, manufactured by BRUKER JAPAN, CO., LTD.). The detailed conditions are as follows.

Tube current: 40 mA
Tube voltage: 40 kV
Goniometer 2θ axis: 20.0000°
Goniometer Ω axis: 0.0000°
Goniometer ϕ axis: 0.0000°
Detector distance: 15 cm (wide angle measuring)
Measuring range: 3.2≤2θ(°)≤37.2
Measuring time: 600 sec.

A collimator having a 1 mm ϕ pinhole is used as the light incident optical system. The obtained two-dimensional data are integrated (X axis: 3.2° to 37.2)° and converted by an attached software to a single-dimensional data of the diffraction intensity and 20.

The capillary used for measuring is a mark tube (Lindemann glass) having a diameter of 0.70 mm. A sample is stuffed to the upper portion of the capillary tube for measuring. The sample is tapped ten times during stuffing.

The calculation method of the crystallinity is described below based on the chart obtained from X-ray diffraction measuring.

Figure 1B:
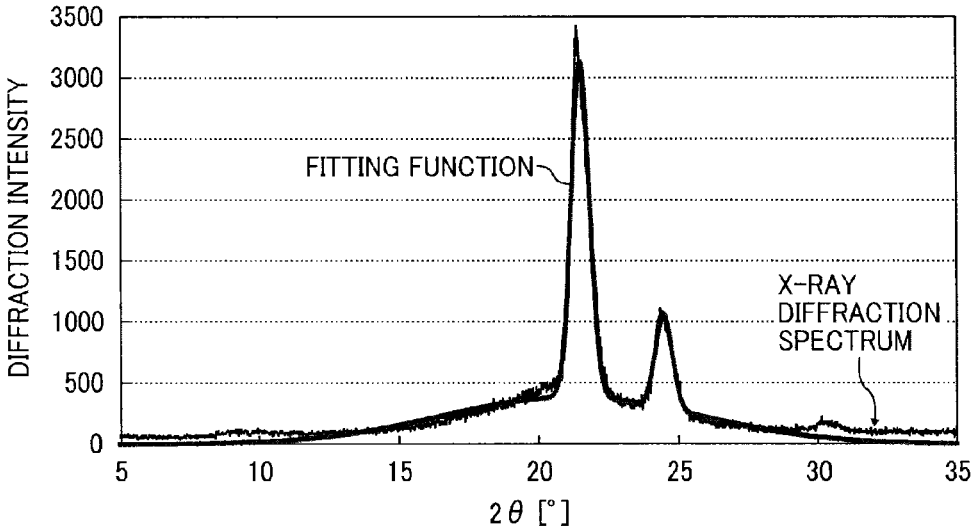

FIGS. 1A and 1B are graphs illustrating examples of diffraction profiles obtained by the X-ray diffraction measuring. X axis is 2θ and Y axis is the X-ray diffraction intensity. Both are linear axes. As illustrated in FIG. 1A, in the X-ray diffraction pattern of the crystalline resin of the present disclosure, main peaks of P1 and P2 are at 2θ of 21.3° and 24.2°. Halo (h) is observed in a wide range including these two peaks.

The main peaks are considered ascribable to the crystalline portions and, the halo, the non-crystalline portion. Make Gaussian function of these two main peaks and halo as follows:

$$f_{p1}(2\theta)=a_{p1}\exp(-(2\theta-b_{p1})^2/(2c_{p1}^2))$$

$$f_{p2}(2\theta)=a_{p2}\exp(-(2\theta-b_{p2})^2/(2c_{p2}^2))$$

$$f_h(2\theta)=a_h\exp(-(2\theta-b_h)^2/(2c_h^2))$$

$f_{p1}(2\theta)$, $f_{p2}(2\theta)$, and $f_h(2\theta)$ are functions corresponding to the main peaks P1 and P2 and halo, respectively.

The sum of these three functions:

$$f(2\theta)=f_{p1}(2\theta)+f_{p2}(2\theta)+f_h(2\theta)$$

is defined as the fitting function of the entire X-ray diffraction spectrum as illustrated in FIG. 1B and fitting is conducted by the least-square approach.

The target of the fitting according to the least-square approach are $a_{p1}$, $b_{p1}$, $c_{p1}$, $a_{p2}$ $b_{p2}$, $c_{p2}$, $a_h$, $b_h$, and $c_h$ with the initial values of $b_{p1}$ of 21.3, $b_{p1}$ of 24.2, and $b_{p1}$ of 22.5. The fitting is conducted after other variables are suitably assigned to make the two main peaks and the halo match the X-ray diffraction profile in some degree.

Fitting may be conducted by, for example, SOLVER of EXCEL 2003 manufactured by MICROSOFT CORPORATION. The crystallinity is calculated as follows by the peak areas (Sp1, Sp2, and Sh) calculated by Gaussian integration of Gaussian functions ($f_{p1}(2\theta)$, $f_{p2}(2\theta)$) corresponding to the two main peaks and Gaussian function ($f_h(2\theta)$) corresponding to the halo after fitting.

$$\text{Crystallinity}(\%)=(Sp1+Sp2)/(Sp1+Sp2+Sh)\times 100$$

Sp1, Sp2, and Sh represent
$a_{p1}C_{p1}\pi^{1/2}$,
$a_{p2}c_{p2}\pi^{1/2}$, and
$a_hc_h\pi^{1/2}$, respectively.

Therefore, the crystallinity (%) is represented by the following relationship:

$$\text{Crystallinity}(\%)=((a_{p1}c_{p1}+a_{p2}c_{p2})/(a_{p1}c_{p1}+a_{p2}c_{p2}+a_hc_h)\times 100$$

Development Agent

The development agent of the present disclosure contains the toner of the present disclosure and other suitably selected components such as carriers. The development agent can be a one-component development agent and a two-component development agent and the two-component development agent is preferable in terms of length of the working life particularly when used in a high speed printer that meets the demand for high speed information processing of late.

In a case of a one-component development agent using the toner described above is used, even when the toner is replenished, the change in the particle diameter of the toner is small, no filming of the toner on the developing roller serving as the development agent bearing member occurs, and no fusion bonding of the toner onto members such as a blade for regulating the thickness of the toner layer occurs. Therefore, good and stable developability is sustained to produce quality images even when the development agent is used (stirred) for an extended period of time. In a case of a two-component development agent using the toner described above is used, even when the toner is replenished for an extended period of time, the change in the particle diameter of the toner in the development agent is small. In addition, good and stable developability is sustained even when the development agent is stirred in the development device for an extended period of time.

Carrier

There is no specific limit to the carrier. A carrier is preferable which contains a core material and a resin layer (cover layer) that covers the core material.

Carrier Core Material

There is no specific limit to the selection of the carrier core material and any particle having magnetism is suitable. Specific examples thereof include, but are not limited to, ferrite, magnetite, iron, and nickel. In addition, in the case of ferrite, considering the adaptability to the environment which has been of a high concern recently, it is preferable to use, for example, manganese ferrite, manganese-magnesium ferrite, manganese strontium ferrite, manganese-magnesium-strontium ferrite, and lithium-based ferrite instead of typical copper-zinc ferrite.

Cover Layer

The cover layer has at least a binder resin and optionally other components such as inorganic particulates.

Binder Resin

There is no specific limit to the binder resin that forms the cover layer of the carrier and any known resin is selectable. Specific examples thereof include, but are not limited to, polyolefin (e.g., polyethylene, polypropylene) and modified products thereof; cross-linked copolymers containing styrene, acrylic resins, acrylonitrile, vinyl acetate, vinyl alcohol, vinyl chloride, vinyl carbazole, and vinyl ether; silicone resins formed of organosiloxane bonding and modified products thereof (e.g., alkyd resins, polyester resins, epoxy resins, polyurethane, and polyimide); polyamide; polyester; polyurethane; polycarbonate; urea resins; melamine resins; benzoguanamine resins; epoxy resins; ionomer resins; polyimide resins; and derivatives thereof. These can be used alone or in combination. Among these, silicone resins are particularly preferred.

There is no specific limit to the silicone resins and any known silicone resins are suitably used. Specific examples thereof include, but are not limited to, straight silicone resins formed of only organosiloxane bonding; and silicone resins modified by alkyd resins, polyester resins, epoxy resins, acrylic resins, urethane resins, etc.

Specific examples of the straight silicone resins include, but are not limited to, KR271, KR272, KR282, KR252, KR255, and KR152 (manufactured by Shin-Etsu CHEMICAL CO., LTD.); and SR2400, SR2405, and SR2406 (manufactured by DOW CORNING TORAY SILICONE CO., LTD.). Specific examples of modified silicone resins include, but are not limited to, epoxy-modified resins (e.g., ES-1001N), acrylic-modified silicone resins (e.g., KR-5208), polyester-modified silicone resins (e.g., KR-5203), alkyd-modified silicone resins (e.g., KR-206), urethane-modified silicone resins (e.g., KR-305) (all of which are manufactured by Shin-Etsu CHEMICAL CO., LTD.); epoxy-modified silicone resins (e.g., SR2115); and alkyd-modified silicone resins (e.g., SR2110) (all manufactured by DOW CORNING TORAY SILICONE CO., LTD.).

It is possible to use a simple silicone resin and also possible to use it with a component that conducts cross-linking reaction, a charge-control component, etc. simultaneously. A specific example of the charge control agents is a silane coupling agent.

Specific examples of the silane coupling agents include, but are not limited to, methyl trimethoxy silane, methyl triethoxy silane, octyl trimethoxy silane, and amino silane coupling agents.

Particulate

The cover layer may contain particulates. There is no specific limit to the particulates and any known material is suitably used.

Specific examples thereof include, but are not limited to, inorganic particulates such as metal powder, tin oxide, zinc oxide, alumina, potassium titanate, barium titanate, and aluminum borate; electroconductive polymer such as polyaniline, polyacetylaene, polyparaphenylene, poly(para-phenyl sulfide), polypyrrole, and parylene; and organic particulates such as carbon black.

The surface of the particulates may be electroconductive treated. A specific method of such electroconductive treatment is covering the surface of the particulate with a form of solid solution and fusion of aluminum, zinc, copper, nickel, silver, and alloyed metal thereof, zinc oxide, titanium oxide, tin oxide, antimony oxide, indium oxide, bismuth oxide, indium oxide in which tin is doped, tin oxide in which antimony is doped, or zirconium oxide. Among these, tin oxide, indium oxide, and indium oxide in which tin is doped are preferable.

The content of the cover layer in the carrier is preferably 5% by weight or more and more preferably from 5% by weight to 10% by weight.

The thickness of the cover layer is preferably from 0.1 μm to 5 μm and more preferably from 0.3 μm to 2 μm.

The thickness of the cover layer can be calculated as the average of the layer thickness obtained by observing 50 or more points of a carrier cross section using a transmission electron microscope (TEM) or scanning type transmission electron microscope (STEM) after making the carrier cross section by, for example, a focused ion beam (FIB).

Method of Forming Carrier Cover Layer

There is no specific limit to the method of forming the cover layer of the carrier and any known method of forming a cover layer is usable. A specific example of the method is coating the surface of the carrier core material with a cover layer solution in which a raw material for the cover layer such as the binder resin and the precursor thereof mentioned above is dissolved by an air spraying method or a dip coating method.

It is preferable to coat the surface of the core material with the cover layer solution (liquid cover) to form a carrier on which the cover layer is formed and heat the carrier to accelerate polymerization reaction of the binder resin or the precursor thereof. The heating treatment may be conducted in the coating device or by another separate heating device such as a typical electric furnace and a baking kiln, etc. after forming the cover layer.

Since the heating temperature depends on the materials for the cover layer, it is not possible to unambiguously determine the temperature. However, it is preferably from about 120° C. to about 350° C. and particularly preferably the decomposition temperature or lower of the materials for the cover layer. The decomposition temperature of the materials for the cover layer is preferably up to about 220° C. and the heating time is preferably from about 5 minutes to about 120 minutes.

Characteristics of Carrier

The volume average particle diameter of the carrier is preferably from 10 μm to 100 μm and more preferably from 20 μm to 65 μm.

When the volume average particle diameter of the carrier is too small, the carrier attachment caused by degradation of the uniformity of the core material particles tends to occur, which is not preferable. When the volume average particle diameter of the carrier is too large, the reproducibility of detailed portions of an image easily worsens, so that a fine image is not obtained, which is not preferable.

There is no specific limit to the measuring method of the volume average particle diameter. Any known instrument that can measure the particle size distribution such as a microtrack particle size analyzer (model HRA 9320-X100, manufactured by NIKKISO CO., LTD.) is suitably usable.

The volume resistivity of the carrier is preferably from 9 [log(Ω·cm)] to 16 [log(Ω·cm)] and more preferably from 10 [log(Ω·cm)] to 14 [log(Ω·cm)].

A volume resistivity of the carrier that is too small tends to cause carrier attachment at non-image portions, which is not preferable. A volume average particle diameter of the carrier that is too large tends to cause the edge effect, in which the image density at edge portions is emphasized during development. The volume resistivity can be adjusted arbitrarily in the range by adjusting the thickness of the cover layer of the carrier and the content of the electroconductive particulate.

A method of measuring the volume resistivity is, for example: fill with the carrier a cell having a fluorine-containing resin container quipped with electrodes 1*a* and 1*b* with a gap of 0.2 cm therebetween and a surface area of 2.5 cm×4 cm; tap the cell under the following conditions: falling height: 1 cm; tapping speed: 30 times/minute; and number of tapping: ten times. Thereafter, apply a direct voltage of 1,000 V between both electrodes: and measure a resistance r[Ω] after 30 seconds by a high resistance meter (HIGH RESISTANCE METER 4329A, manufactured by HEWLETT-PACKARD, JAPAN, LTD.) to calculate the volume resistivity R [log (Ω·cm) according to the following relationship 1.

$$R = \text{Log}\,[r \times (2.5\ \text{cm} \times 4\ \text{cm})/0.2\ \text{cm}] \qquad \text{Relationship 1}$$

When the development agent described above is a two component development agent, the mixing ratio of the toner to the carrier is preferably from 2.0% by weight to 12.0% by weight and more preferably from 2.5% by weight to 10.0% by weight.

Image Formation Method and Image Forming Apparatus

The image formation method of the present disclosure includes a latent electrostatic image forming process, a development process, a transfer process, and a fixing process with optional processes such as a cleaning process, a discharging process, a recycling process, and a control process.

The image forming apparatus of the present disclosure includes at least a latent electrostatic image bearing member (photoreceptor), a latent electrostatic image forming device, a development device, a transfer device, and a fixing device with optional devices such as a cleaner, a discharging device, a recycling device, and a control device.

Latent Image Formation Process and Device

The latent electrostatic image forming process is a process of forming a latent electrostatic image on a latent electrostatic image bearing member.

There is no specific limit to the latent electrostatic image bearing member (also referred to as image bearing member or photoreceptor) with regard to material, form, structure, size, etc. and any known image bearing member can be suitably selected. An image bearing member having a drum form is preferred. Also, for example, an inorganic image bearing member is formed of amorphous silicone or selenium and an organic image bearing member [organic photoconductor (OPC)] is formed of polysilane or phthalopolymethine. Among these, amorphous silicon, etc. is preferred in terms of long working life.

Latent electrostatic images are formed by, for example, uniformly charging the surface of the image bearing member and irradiating the surface according to the obtained image information using the latent electrostatic image forming device.

The latent electrostatic image forming device includes at least a charger serving as a charging device which uniformly charges the surface of the image bearing member and an irradiator serving as an irradiating device which irradiates the surface of the image bearing member with light according to the obtained image information.

The surface of the image bearing member is charged by, for example, applying a voltage to the surface of the image bearing member with the charger.

There is no specific limit to the charger and any known charger can be selected. A known contact type charger having an electroconductive or semi-electroconductive roll, brush, film, rubber blade, etc. and a non-contact type charger such as a corotron or a scorotron which uses corona discharging can be used.

It is preferable to apply a direct current or a voltage obtained by superimposing an alternate current voltage on a direct current voltage to the surface of the latent electrostatic image bearing member by the charging device arranged in contact with or in the vicinity of the latent electrostatic image bearing member.

It is preferable to apply a direct current or a voltage obtained by superimposing an alternate current voltage on a direct current voltage to the surface of the latent electrostatic image bearing member by the charging device arranged in contact with or in the vicinity of the latent electrostatic image bearing member.

The irradiation is conducted by, for example, irradiating the surface of the image bearing member with the irradiator according to image data.

There is no specific limit to the selection of the irradiator as long as the irradiator irradiates the surface of the latent image bearing member charged by an charger according to data information. Specific examples thereof include, but are not limited to, various kinds of irradiator such as photocopying optical systems, rod-lens array systems, laser optical systems, and liquid crystal shutter optical systems.

As to the present disclosure, the rear side irradiation system in which an image bearing member is irradiated from the rear side thereof can be also employed.

Development Process and Development Device

The development process is a process of forming a visual image by developing the latent electrostatic image with the development agent of the present disclosure.

The visual image is formed by, for example, developing the latent electrostatic image by the development device with the development agent of the present disclosure.

Any known development device that can conduct development with the development agent of the present disclosure is suitably selected. For example, a development device that has a development unit which accommodates the development agent of the present disclosure and provides the development agent to the latent electrostatic image in a contact or non-contact manner is suitably usable and the development unit that accommodates the development agent container is preferable.

The development device is either of a single color development type or a multi-color development type. The development device suitably includes, for example, a stirrer to triboelectrically charge the development agent and a rotatable magnet roller.

In the development device, the toner and a carrier are mixed and stirred to triboelectrically charge the toner. The toner is then held on the surface of the rotatable magnet roller to form a magnet brush like a filament. Since the magnet roller is provided in the vicinity of the latent electrostatic image bearing member, part of the toner forming the magnet brush borne on the surface of the magnet roller is transferred to the surface of the latent electrostatic image bearing member by the force of the electric attraction. As a result, the latent electrostatic image is developed with the toner and visualized as a toner image on the surface of the image bearing member.

The development agent accommodated in the development device is the development device of the present disclosure.

Transfer Process and Transfer Device

The transfer process mentioned above is a process in which the visualized image mentioned above is transferred to a recording medium. It is preferred that the visualized image is primarily transferred to an intermediate transfer body and thereafter secondarily transferred to the recording medium. Further, it is more preferred use a two-color toner, preferably a full color toner in the processes in which the visualized image is primarily transferred to an intermediate transfer body to form a complex transfer image and the complex transfer image is thereafter secondarily transferred to the recording medium.

The transfer of the visual image is conducted by, for example, the transfer device by charging the latent electrostatic image bearing member (photoreceptor) by using the transfer charger.

The transfer device preferably has a primary transfer device to form a complex transfer image by transferring the visual image to an intermediate transfer body and a secondary transfer device to transfer the complex transfer image to a recording medium. There is no specific limit to the selection of the intermediate transfer body. Any known transfer body such as an intermediate transfer belt can be suitably selected and used.

The transfer device (the primary transfer device and the secondary transfer device) preferably has a transfer unit which peeling-charges the visual image formed on the latent electrostatic image bearing member to the side of the recording medium. One or more transfer devices can be provided.

Specific examples of the transfer units include, but are not limited to, a corona transfer unit using corona discharging, a transfer belt, a transfer roller, a pressure transfer roller, and an adhesive transfer unit.

There is no specific limitation to the recording medium and any known recording medium (typically paper) can be suitably used.

Fixing Process and Fixing Device

The fixing process is a process in which the visual image transferred to the recording medium is fixed by a fixing device. Fixing can be performed every time each color toner image is transferred or at once for a multi-color overlapped (superimposed) image.

Any fixing device can be suitably selected. Any known heating and pressure device can be used. Known pressure and heating devices are preferably used and formed of, for example, a combination of a heating roller and a pressure roller or a combination of a heating roller, a pressure roller and an endless belt.

For example, a suitable fixing device has a heating body that has a heat-generating element, a film in contact with the heating body, and a pressing member that presses the hearing body via the film to fix the un-fixed image on a recording medium while the recording medium passes between the film and the pressing member. The heating temperature by the heating and pressure device is preferably from 80° C. to 200° C.

In the fixing process for use in the present disclosure, for example, any known optical fixing device can be used together with or in place of the fixing device and the fixing process described above.

The discharging process is a process in which a discharging bias is applied to the latent electrostatic image bearing member to discharge the latent electrostatic image bearing member and is suitably performed by a discharging device.

There is no specific limit to the discharging device and any known discharging device is suitably usable. For example, a discharging lamp is suitable.

The cleaning process is a process of removing toner remaining on the surface of the latent image bearing member and can be suitably conducted by a cleaning device.

Any known cleaning device that can remove the toner remaining on the surface of the latent image bearing member is suitably selected and used. For example, a magnetic brush cleaner, an electrostatic brush cleaner, a blade cleaner, a brush cleaner, and a web cleaner are preferable.

The recycling process is a process in which the toner removed in the cleaning process mentioned above is returned to the development device for re-use. This recycling process is suitably conducted by a recycling device. There is no specific limit to the recycling device and any known conveying device, etc., can be used.

The controlling process mentioned above is a process of controlling each process and the controlling can be suitably performed by a controlling device.

There is no specific limit to the control device as long as it can control the behavior of each device. Any control device is suitably usable. For example, devices such as a sequencer and a computer can be used.

Figure 2:
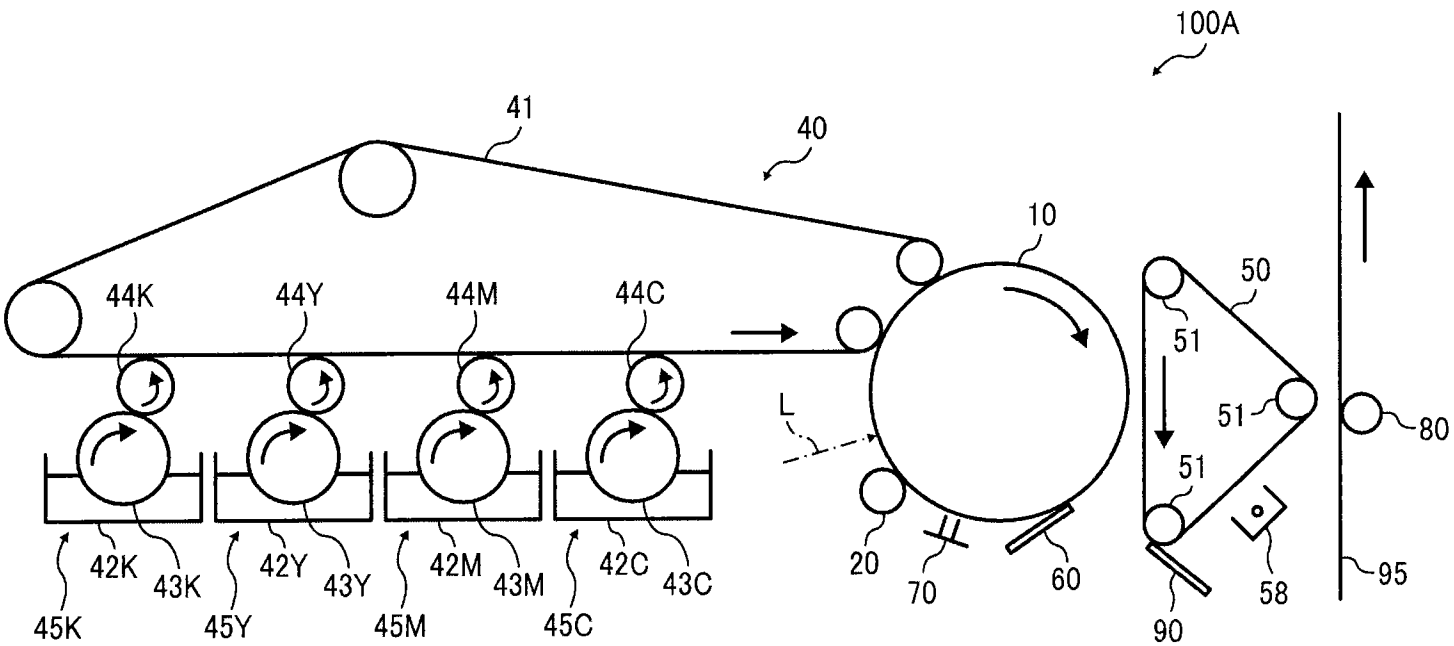
FIG. 2 is a schematic diagram illustrating an example of an image forming apparatus of the present invention.

FIG. 2 is a diagram illustrating an example of the image forming apparatus for use in the present disclosure. An image forming apparatus 100A includes an image bearing drum 10, a charging roller 20, an irradiator, a development device 40, an intermediate transfer belt 50, a cleaning device 60 having a cleaning blade, and a discharging lamp 70.

The intermediate transfer belt 50 is an endless belt suspended over three rollers 51 provided inside and moves in the direction indicated by an arrow in FIG. 2. Part of the three rollers 51 has a feature as a transfer bias roller that can apply a transfer bias (primary transfer bias) to the intermediate transfer belt 50. Around the intermediate transfer belt 50, there is arranged a cleaning device 90 having a cleaning blade. Furthermore, a transfer roller 80 that can apply a transfer bias (secondary transfer bias) to a transfer sheet 95 to transfer the toner image thereto is provided facing the intermediate transfer belt 50. In addition, around the intermediate transfer belt 50, there is provided a corona charger 58 to impart charges on the toner image transferred to the intermediate transfer belt 50 between the contact portion of the image bearing drum 10 and the intermediate transfer belt 50 and the contact portion between the intermediate transfer belt 50 and the transfer sheet 95 relative to the rotation direction of the intermediate transfer belt 50.

The development device 40 includes a development belt 41, a black development unit 45K, a yellow development unit 45Y, a magenta development unit 45M, and a cyan development unit 45C provided around the development belt 41. Each development unit 45 (45Y, 45M, 45C, and 45K) has a development agent container 42 (42Y, 42M, 42C, and 42K), a development supplying roller 43 (43Y, 43M, 43C, and 43K), and a development roller 44 (44Y, 44M, 44C, and 44K). In addition, the development belt 41 is an endless belt suspended over multiple belt rollers and moves in the direction indicated by an arrow in FIG. 2. Furthermore, part of the development belt 41 contacts the image bearing drum 10.

The method of forming images using the image forming apparatus 100A is described next. First, after charging the surface of the image bearing drum 10 using the charging roller 20, a latent electrostatic image is formed by irradiating the image bearing drum 10 with irradiation light L. Next, the latent electrostatic image formed on the image bearing drum 10 is developed with the toner supplied from the development device 40 to form a toner image. Moreover, the toner image formed on the image bearing drum 10 is (primarily) transferred to the intermediate transfer belt 50 by a transfer bias applied by the roller 51 and thereafter (secondarily) transferred to the transfer sheet 95 by a transfer bias applied by the transfer roller 80. With regard to the image bearing drum 10 from which the toner image has been transferred to the intermediate transfer belt 50, the toner remaining on the surface is removed by the cleaning device 60 and thereafter discharged by the discharging lamp 70.

Figure 3:
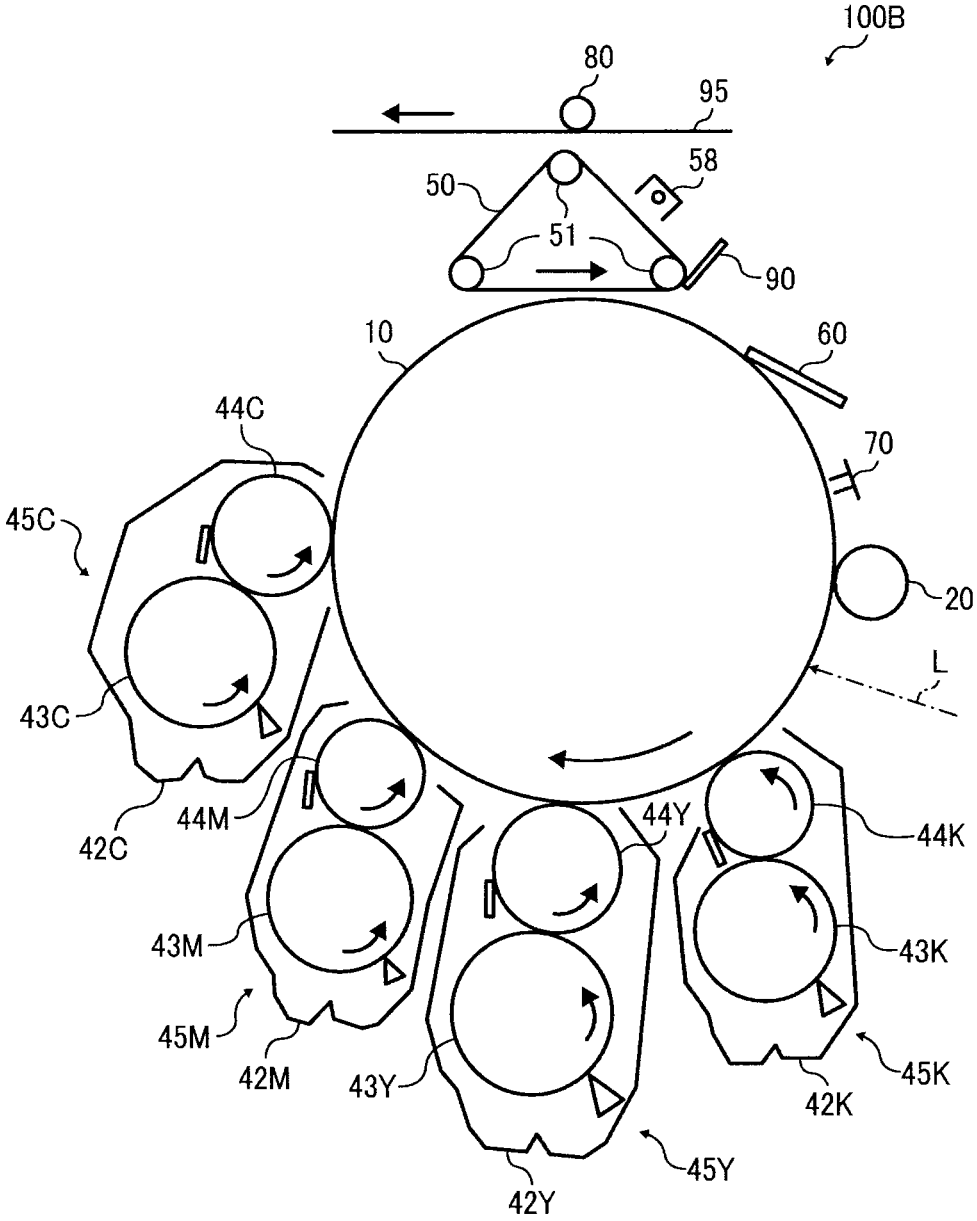
FIG. 3 is a schematic diagram illustrating another example of the image forming apparatus of the present disclosure.

FIG. 3 is a diagram illustrating another example of the image forming apparatus for use in the present disclosure. An image forming apparatus 100B has the same structure as the image forming apparatus 100A except that the black development unit 45K, the yellow development unit 45Y, the magenta development unit 45M, and the cyan development unit 45C are provided around the image bearing drum 10 while directly facing the image bearing drum 10 with no development belt 41.

Figure 4:
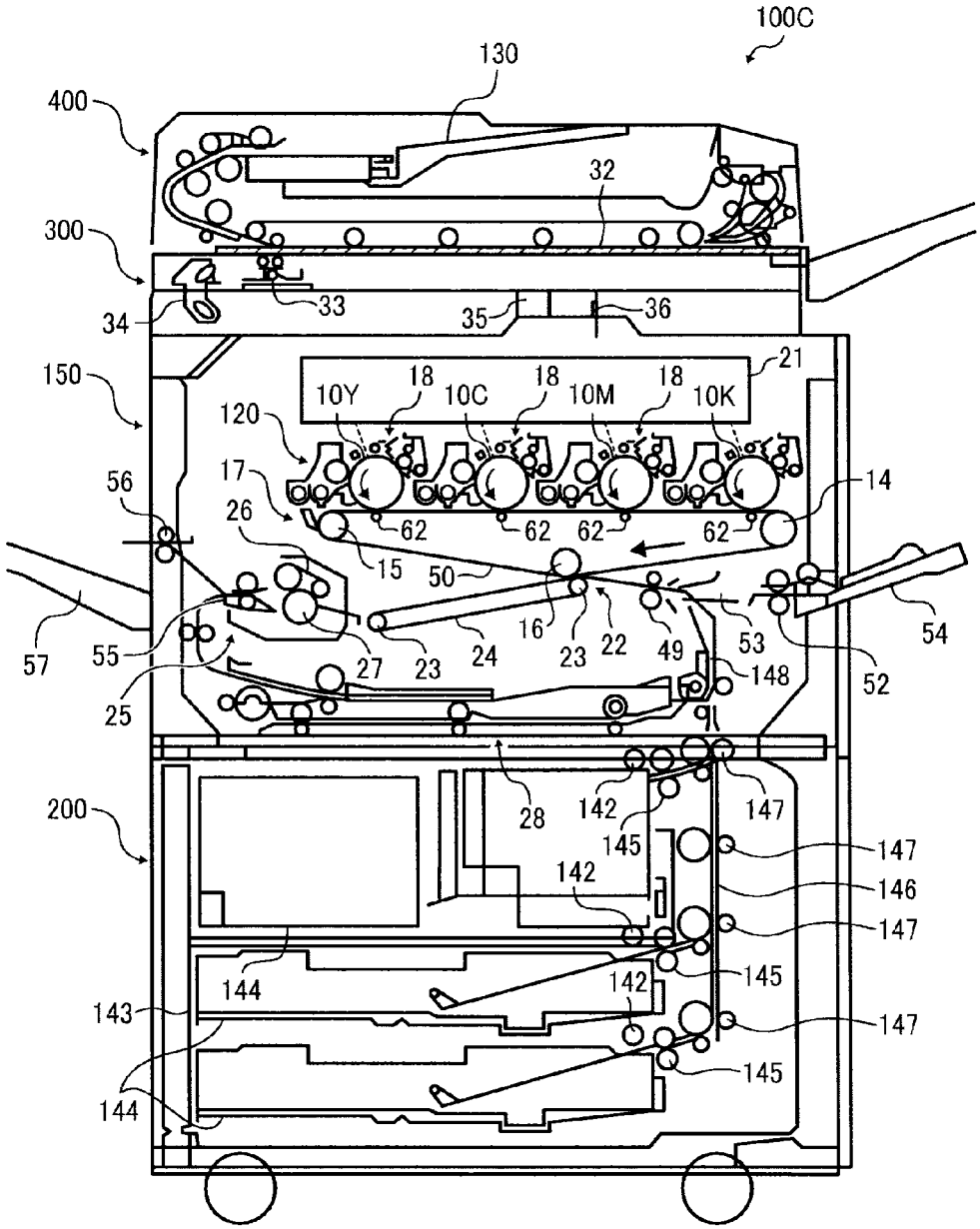
FIG. 4 is a schematic diagram illustrating an example of an image forming apparatus (tandem system, color printing) of the present disclosure.

FIG. 4 is a diagram illustrating another example of the image forming apparatus for use in the present disclosure. An image forming apparatus 100C is a tandem type color image forming apparatus, and includes a photocopying unit 150, a sheet feeder table 200, a scanner 300, and an automatic document feeder (ADF) 400.

The intermediate transfer belt 50 provided at the center of the photocopying unit 150 is an endless belt suspended over three rollers 14, 15, and 16 and moves in the direction indicated by an arrow in FIG. 4. Around the roller 15, a cleaning device 17 is provided which has a cleaning blade to remove toner remaining on the intermediate transfer belt 50 from which the toner image is transferred to a recording medium. An image formation unit 120 for yellow, cyan, magenta and black is arranged along the transfer direction of the intermediate transfer belt 50 while facing the intermediate transfer belt 50 suspended between the rollers 14 and 15. In addition, an irradiation device 21 is arranged near an image formation unit 120. Furthermore, a secondary transfer belt 24 is arranged on a side opposite to the side on which the image formation unit 120 is provided relative to the intermediate transfer belt 50. The secondary transfer belt 24 is an endless belt suspended over a pair of rollers 23 and the recording medium transferred on the transfer belt 24 and the intermediate transfer belt 50 can contact each other between the rollers 16 and 23. In addition, around the secondary transfer belt 24, there are arranged a fixing belt 26 suspended over a pair of rollers and a fixing device 25 having a pressing roller 27 pressed to the fixing belt 26. Furthermore, close to the secondary transfer belt 24 and the fixing device 25, there is provided a sheet reversing device 28 to reverse the recording medium to form images on both sides of the recording medium.

A method of forming full color images using the image forming apparatus 100C is described. First, a color document is set on a document table 130 of the automatic document feeder (ADF) 400, or after the automatic document feeder 400 is opened, a color document is set on a contact glass 32, and then the automatic document feeder 400 is shut. After the document moves to the contact glass 32 by pressing a start button in a case in which the document is set on the automatic document feeder 400 or immediately in a case in which the document is set on the contact glass 32, the scanner 300 is driven to start scanning with a first scanning unit 33 having a light source and a second scanning unit 34 having a mirror. The irradiation light from the first carrier 33 is reflected at the document and the reflected light is reflected at the second carrier 34. Thereafter, the reflected light is received at a reading sensor 36 via an image focusing lens 35 to read the document and thus image information of black, yellow, magenta, and cyan of the document is obtained.

Figure 5:
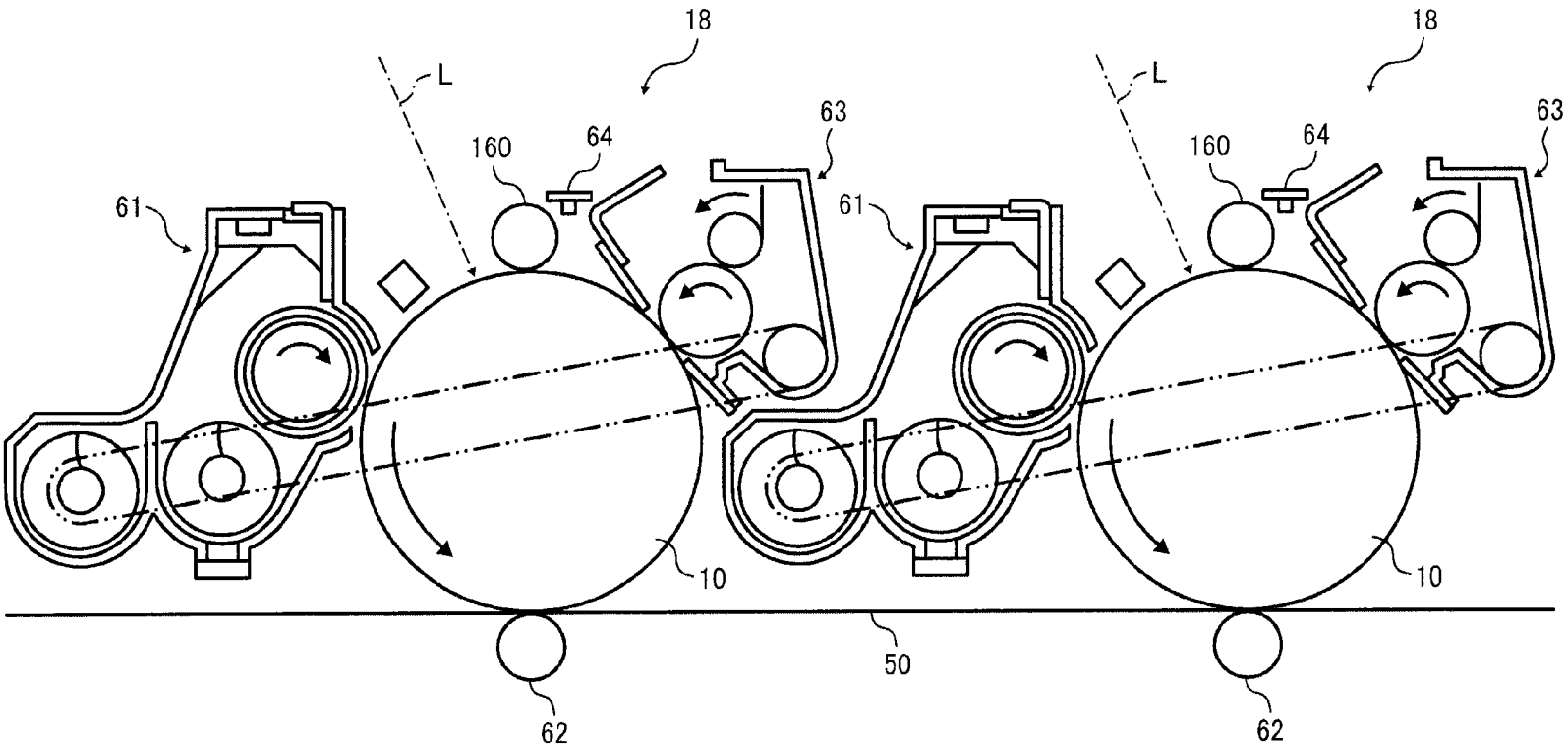
FIG. 5 is an enlarged schematic diagram of a portion of the image forming apparatus illustrated in FIG. 4.

Image information of each color is transmitted to each color image formation unit 120 where each color toner image is formed. As illustrated in FIG. 5, each color image formation unit 120 includes an image bearing drum 10, a charging roller 160 that charges the image bearing drum 10 (10Y, 10C, 10M, and 10K), an irradiator to form each color latent electrostatic image by irradiating the image bearing drum 10 with irradiation light L, a development device 61 to form each color toner image by developing a latent electrostatic image with each color development agent, a transfer roller 62 to transfer the toner image to the intermediate transfer belt 50, a cleaning device 63 having a cleaning blade, and a discharging lamp 64.

Each color toner image formed on each image formation unit 120 is sequentially and primarily transferred to the intermediate transfer belt 50 suspended over the rollers 14, 15, and 16 to superimpose a complex toner image.

In the sheet feeder table 200, one of the sheet feeder rollers 142 is selectively rotated to bring up recording media (sheets) from one of multiple sheet cassettes 144 stacked in a sheet bank 143. A separating roller 145 separates the recording media one by one to feed it to a sheet path 146. Transfer rollers 147 transfer and guide the recording medium to a sheet path 148 in the main portion 150 of the image forming apparatus 100 and the recording medium strikes at a registration roller 49 and is held there. Alternatively, the recording media on a manual tray 54 are brought up by rotating a sheet feeding roller, and separated one by one by a separating roller 52, transferred to a manual sheet path 53, and struck and held at a registration roller 49. The registration roller 49 is typically grounded but a bias can be applied thereto to remove paper dust on the recording medium. The registration roller 49 is rotated in synchronization with the complex toner image (color transfer image) on the intermediate transfer belt 50 to send the recording medium (sheet) between the intermediate transfer belt 50 and the secondary transfer device 24 and secondarily transfer the complex toner image to the recording medium. The toner remaining on the intermediate transfer belt 50 from which the complex toner image has been transferred is removed by the cleaning device 17.

The recording medium to which the complex toner image is transferred is transferred by the secondary transfer belt 24 and then fixed by the fixing device 25. Next, the recording medium is discharged on a discharging tray 57 by a discharging roller after a switching claw 55 switches the transfer path. Alternatively, after switching claw 55 switches the transfer path, the recording medium is reversed by the sheet reversing device 28 and an image is formed on the reverse side of the recording medium and thereafter the recording medium is discharged on the discharging tray 57 by the discharging roller 56.

The image forming apparatus of the present disclosure produces quality images with high gloss over an extended period of time using the toner of the present disclosure.

These and other objects, features and advantages of the present invention will become apparent upon consideration of the following description of the preferred embodiments of the present invention (taken in conjunction with the accompanying drawings.

EXAMPLES

Next, the present disclosure is described in detail with reference to Examples but not limited thereto.

Manufacturing Example 1

Manufacturing of Releasing Agent 1

Place 340 g (1.00 mol) of behenic acid, 326 g (1.00 mol) of behenyl alcohol, and 20 ml of sulfuric acid in a flask equipped with a stirrer, a condenser, and a thermometer and heat the flask at 130° C. for four hours for refluxing while distilling away produced water. Refine the reactant with methylether to obtain an alkyl monoester compound (releasing agent 1).

Manufacturing Example 2

Manufacturing of Releasing Agent 2

Place 340 g (1.00 mol) of behenic acid, 298 g (1.00 mol) of eicosanol, and 20 ml of sulfuric acid in a flask equipped with a stirrer, a condenser, and a thermometer and heat the flask at 200° C. for five hours for refluxing while distilling away produced water. Refine the reactant with petrol ether to obtain an alkyl monoester compound (releasing agent 2).

Manufacturing Example 3

Manufacturing of Releasing Agent 3

Place 340 g (1.00 mol) of behenic acid, 270 g (1.00 mol) of stearic alcohol, and 20 ml of sulfuric acid in a flask equipped with a stirrer, a condenser, and a thermometer and heat the flask at 150° C. for five hours for refluxing while distilling away produced water. Refine the reactant with propylether to obtain an alkyl monoester compound (releasing agent 3).

Manufacturing Example 4

Manufacturing of Releasing Agent 4

Place 284 g (1.00 mol) of stearic acid, 270 g (1.00 mol) of stearic alcohol, and 20 ml of sulfuric acid in a flask equipped with a stirrer, a condenser, and a thermometer and heat the flask at 130° C. for four hours for refluxing while distilling away produced water. Refine the reactant with methylether to obtain an alkyl monoester compound (releasing agent 4).

Manufacturing Example 5

Manufacturing of Releasing Agent 5

Place 284 g (1.00 mol) of stearic acid, 242 g (1.00 mol) of cetyl alcohol, and 20 ml of sulfuric acid in a flask equipped with a stirrer, a condenser, and a thermometer and heat the flask at 200° C. for five hours for refluxing while distilling away produced water. Refine the reactant with petrol ether to obtain an alkyl monoester compound (releasing agent 5).

Manufacturing Example 6

Manufacturing of Releasing Agent 6

Place 228 g (1.00 mol) of myristic acid, 242 g (1.00 mol) of cetyl alcohol, and 20 ml of sulfuric acid in a flask equipped with a stirrer, a condenser, and a thermometer and heat the flask at 200° C. for five hours for refluxing while distilling away produced water. Refine the reactant with petrol ether to obtain an alkyl monoester compound (releasing agent 6).

Manufacturing Example 7

Manufacturing of Releasing Agent 7

Place 228 g (1.00 mol) of myristic acid, 214 g (1.00 mol) of myristyl alcohol, and 20 ml of sulfuric acid in a flask equipped with a stirrer, a condenser, and a thermometer and heat the flask at 200° C. for five hours for refluxing while distilling away produced water. Refine the reactant with petrol ether to obtain an alkyl monoester compound (releasing agent 7).

The raw material compositions, the melting points (Tm), the melt viscosity, the acid value (AV), and the carbon atom distribution (content % by weight of each number of carbon atoms based on the number of carbon atoms in the alkyl group in the molecule) of the releasing agents 1 to 7 are shown in Table 1.

TABLE 1

| | | Releasing Agent | | | | | |
|---|---|---|---|---|---|---|---|
| | | 1 | | 2 | | 3 | |
| | | Parts | Mol number | Parts | Mol number | Parts | Mol number |
| Alcohol component | Myristyl alcohol | | | | | | |
| | Cetyl alcohol | | | | | | |
| | Stearyl alcohol | | | | | 270 | 1.00 |
| | Eicosanol | | | 298 | 1.00 | | |
| | Behenyl alcohol | 326 | 1.00 | | | | |
| Carboxylic acid component | Myristic acid | | | | | | |
| | Stearic acid | | | | | | |
| | Behenic acid | 340 | 1.00 | 340 | 1.00 | 340 | 1.00 |
| Melting point (Tm) ° C. | | 71 | | 68 | | 65 | |
| Melt viscosity (100° C.) mPa · sec. | | 8.5 | | 8.1 | | 7.4 | |
| AV mgKOH/g | | 2.2 | | 1.5 | | 1.8 | |
| | C46 or higher | 0.7 | | 0 | | 0 | |
| | C44 | 89.6 | | 0.8 | | 0 | |
| | C42 | 5.8 | | 88.2 | | 0.6 | |

TABLE 1-continued

| | | | | |
|---|---|---|---|---|
| | C40 | 0.4 | 7.1 | 88.5 |
| | C38 | 0 | 0.3 | 6.6 |
| | C36 | 0 | 0 | 0.5 |
| | C34 | 0 | 0 | 0 |
| | C32 | 0 | 0 | 0 |
| | C30 | 0 | 0 | 0 |
| | C28 | 0 | 0 | 0 |
| | C26 | 0 | 0 | 0 |
| | C24 | 0 | 0 | 0 |
| | C22 or lower | 3.5 | 3.6 | 3.8 |

| | | Releasing Agent | | | | | | | |
|---|---|---|---|---|---|---|---|---|---|
| | | 4 | | 5 | | 6 | | 7 | |
| | | Parts | Mol number | Parts | Mol number | Parts | Mol number | Parts | Mol number |
| Alcohol component | Myristyl alcohol | | | | | | | 214 | 1.00 |
| | Cetyl alcohol | | | 242 | 1.00 | 242 | 1.00 | | |
| | Stearyl alcohol | 270 | 1.00 | | | | | | |
| | Eicosanol | | | | | | | | |
| | Behenyl alcohol | | | | | | | | |
| Carboxylic acid component | Myristic acid | | | | | 228 | 1.00 | 228 | 1.00 |
| | Stearic acid | 284 | 1.00 | 284 | 1.00 | | | | |
| | Behenic acid | | | | | | | | |
| Melting point (Tm) ° C. | | 61 | | 58 | | 51 | | 46 | |
| Melt viscosity (100° C.) mPa · sec. | | 6.7 | | 6.1 | | 5.6 | | 5.2 | |
| AV mgKOH/g | | 2.5 | | 3.1 | | 2.1 | | 3.3 | |
| | C46 or higher | 0 | | 0 | | 0 | | 0 | |
| | C44 | 0 | | 0 | | 0 | | 0 | |
| | C42 | 0 | | 0 | | 0 | | 0 | |
| | C40 | 0 | | 0 | | 0 | | 0 | |
| | C38 | 0.3 | | 0 | | 0 | | 0 | |
| | C36 | 89.5 | | 0.3 | | 0 | | 0 | |
| | C34 | 7.3 | | 88.2 | | 0 | | 0 | |
| | C32 | 0.2 | | 3.9 | | 1.5 | | 0.2 | |
| | C30 | 0 | | 2.1 | | 86.5 | | 2.8 | |
| | C28 | 0 | | 1.0 | | 8.1 | | 84.7 | |
| | C26 | 0 | | 0 | | 0.4 | | 7.2 | |
| | C24 | 0 | | 0 | | 0 | | 1.3 | |
| | C22 or lower | 2.7 | | 4.5 | | 3.5 | | 3.8 | |

Manufacturing Example 8

Manufacturing of Crystalline Polyurethane Resin D-1

Place 45 parts (0.50 mol) of 1,4-butane diol, 59 parts (0.50 mol) of 1,6-hexane diol, and 200 parts of methylethyl ketone (MEK) in a reaction container equipped with a stirrer and a thermometer. Add 250 parts (1.00 mol) of 4,4'-diphenyl methane diisocyanate (MDI) to this solution to conduct reaction at 80° C. for five hours and remove the solvent to obtain [Crystalline Polyurethane Resin D-1]. The thus-obtained [Crystalline Polyurethane Resin D-1] has an Mw of 20,000 and a melting point of 60° C.

Manufacturing Example 9

Manufacturing of Urethane-Modified Crystalline Polyester Resin D-2

Place 202 parts (1.00 mol) of sebacic acid, 15 parts (0.10 mol) of adipic acid, 177 parts (1.50 mol) of 1,6-hexane diol, and 0.5 parts of tetrabuthoxy titanate as a condensing catalyst in a reaction container equipped with a condenser, a stirrer, and a nitrogen introducing tube to conduct reaction at 180° C. for eight hours in a nitrogen atmosphere while distilling away produced water. Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 12,000 to obtain [Crystalline Polyester Resin D'-2]. The thus-obtained [Crystalline Polyester Resin D'-2] has an Mw of 12,000.

Transfer the thus obtained [Crystalline Polyester Resin D'-2] to a reaction container equipped with a condenser, a stirrer, and a nitrogen introducing tube and add 350 parts of ethyl acetate and 30 parts (0.12 mol) of 4,4'-diphenyl methane diisocyanate (MDI) thereto to conduct reaction at 80° C. in a nitrogen atmosphere for five hours. Next, distil away ethyl acetate under a reduced pressure to obtain [Urethane-Modified Crystalline Polyurethane Resin D-2]. The thus-obtained

[Urethane-Modified Crystalline Polyester Resin D-2] has an Mw of 22,000 and a melting point of 62° C.

Manufacturing Example 10

Manufacturing of Urethane-Modified Crystalline Polyester Resin D-3

Place 185 parts (0.19 mol) of sebacic acid, 13 parts (0.09 mol) of adipic acid, 106 parts (1.18 mol) of 1,4-butane diol, and 0.5 parts of titanium dihydroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water. Next, conduct reaction for four hours while gradually heating the system to 220° C. and distilling away produced water and 1,4-butane diol in a nitrogen atmosphere and continue the reaction with a reduced pressure of 5 mmHg to 20 mmHg until the weight average molecular weight Mw of the resultant reaches about 14,000 to obtain [Crystalline Polyester Resin D'-3]. The thus-obtained [Crystalline Polyester Resin D'-3] has an Mw of 14,000.

Transfer the thus-obtained [Crystalline Polyester Resin D'-3] to a reaction container equipped with a condenser, a stirrer, and a nitrogen introducing tube and add 250 parts of ethyl acetate and 12 parts (0.07 mol) of hexamethylene diisocyanate (HDI) thereto to conduct reaction at 80° C. in a nitrogen atmosphere for five hours. Next, distil away ethyl acetate under a reduced pressure to obtain [Urethane-Modified Crystalline Polyester Resin D-3]. The thus-obtained [Urethane-Modified Crystalline Polyester Resin D-3] has an Mw of 39,000 and a melting point of 63° C.

Manufacturing Example 11

Manufacturing of Urethane-Modified Crystalline Polyester Resin D-4

Place 202 parts (1.00 mol) of sebacic acid, 149 parts (1.26 mol) of 1,6-hexane diol, and 0.5 parts of tetrabuthoxy titanate as a condensing catalyst in a reaction container equipped with a condenser, a stirrer, and a nitrogen introducing tube to conduct reaction at 180° C. for eight hours in a nitrogen atmosphere while distilling away produced water. Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 9,000 to obtain [Crystalline Polyester Resin D'-4]. The thus-obtained [Crystalline Polyester Resin D'-4] has an Mw of 9,000.

Transfer the thus obtained [Crystalline Polyuester Resin D'-4] to a reaction container equipped with a condenser, a stirrer, and a nitrogen introducing tube and add 250 parts of ethyl acetate and 28 parts (0.11 mol) of 4,4'-diphenyl methane diisocyanate (MDI) thereto to conduct reaction at 80° C. in a nitrogen atmosphere for five hours. Next, distil away ethyl acetate under a reduced pressure to obtain [Urethane-Modified Crystalline Polyester Resin D-4]. The thus-obtained [Urethane-Modified Crystalline Polyester Resin D-4] has an Mw of 30,000 and a melting point of 67° C.

Manufacturing Example 12

Manufacturing of Crystalline Polyester Resin D-5

Place 202 parts (1.00 mol) of sebacic acid, 130 parts (1.10 mol) of 1,6-hexane diol, and 0.5 parts of tetrabuthoxy titanate as a condensing catalyst in a reaction container equipped with a condenser, a stirrer, and a nitrogen introducing tube to conduct reaction at 180° C. for eight hours in a nitrogen atmosphere while distilling away produced water. Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the Mw reaches about 30,000 to obtain [Crystalline Polyester Resin D-5]. The thus-obtained [Crystalline Polyester Resin D-5] has an Mw of 27,000 and a melting point of 62° C.

Manufacturing Example 13

Manufacturing of Block Resin D-6 Having Crystalline Portion and Non-crystalline Portion Place 25 parts (0.33 mol) of 1,2-propylene glycol and 170 parts of methylethyl ketone (MEK) in a reaction container equipped with a condenser, a stirrer, and a nitrogen introducing tube followed by stirring and add 147 parts (0.59 mol) of 4,4'-diphenyl methane diisocyanate (MDI) thereto to conduct reaction at 80° C. in a nitrogen atmosphere for five hours to obtain an MEK solution of [Non-Crystalline Portion f-1] having an isocyanate group at its end.

Place 202 parts (1.00 mol) of sebacic acid, 160 parts (1.35 mol) of 1,6-hexane diol, and 0.5 parts of tetrabuthoxy titanate as a condensing catalyst in a reaction container equipped with a condenser, a stirrer, and a nitrogen introducing tube to conduct reaction at 180° C. for eight hours in a nitrogen atmosphere while distilling away produced water. Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the Mw reaches about 9,000 to obtain [Crystalline Polyester Resin D'-6]. The thus-obtained [Crystalline Polyester Resin D'-6] has an Mw of 8,500 and a melting point of 63° C.

Next, add a solution in which 320 parts of the [Crystalline Polyester Resin D'-6] is dissolved in 320 parts of MEK as the crystalline portion to 340 parts of MEK solution of [Non-Crystalline Portion f-1] to conduct reaction at 80° C. for five hours in a nitrogen atmosphere. Thereafter, distil away the MEK to obtain [Block Resin D-6]. The thus-obtained [Block Resin D-6] has an Mw of 26,000 and a melting point of 62° C.

Manufacturing Example 14

Manufacturing of Urethane-Modified Crystalline Polyester Resin E-1

Place 113 parts (0.56 mol) of sebacic acid, 109 parts (0.56 mol) of dimethyl terephthalate, 132 parts (1.12 mol) of 1,6-hexane diol, and 0.5 parts of titanium dihydroxybis(triethanol aminate) as a condensing catalyst in a reaction container equipped with a condenser, a stirrer, and a nitrogen introducing tube to conduct reaction at 180° C. for eight hours in a nitrogen atmosphere while distilling away produced water and methanol.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the Mw reaches about 35,000 to obtain [Crystalline Polyester Resin F-1]. The thus-obtained [Crystalline Polyester Resin F-1] has an Mw of 34,000.

Transfer the thus-obtained [Crystalline Polyester Resin F-1] to a reaction container equipped with a condenser, a stirrer, and a nitrogen introducing tube and add 200 parts of ethyl acetate and 10 parts (0.06 mol) of hexamethylene diisocyanate (HDI) thereto to conduct reaction at 80° C. in a nitrogen atmosphere for five hours. Next, distil away ethyl acetate under a reduced pressure to obtain [Urethane-Modified Crystalline Polyester Resin E-1]. The thus-obtained [Urethane-Modified Crystalline Polyester Resin E-1] has a Mw of 63,000 and a melting point of 65° C.

Manufacturing Example 15

Manufacturing of Crystalline Resin Precursor E'-2

Place 202 parts (1.00 mol) of sebacic acid, 130 parts (1.10 mol) of 1,6-hexane diol, and 0.5 parts of titanium dihydroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 25,000.

Transfer the thus-obtained crystalline resin to a reaction container equipped with a condenser, a stirrer, and a nitrogen introducing tube and add 300 parts of ethyl acetate and 27 parts of hexamethylene diisocyanate (HDI) thereto to conduct reaction at 80° C. in a nitrogen atmosphere for five hours to obtain a 50% by weight ethyl acetate solution of [Crystalline Resin Precursor E'-2] having an isocyanate group at its end.

Mix 10 parts of the thus-obtained ethyl acetate solution of [Crystalline Resin Precursor E'-2] with 10 parts of tetrahydrofuran (THF) followed by an addition of 1 part of dibutyl amine and a two-hour stirring.

As a result of GPC measuring the thus-obtained solution as a sample, the [Crystalline Resin Precursor E'-2] has an Mw of 54,000.

In addition, as a result of DSC measuring a sample obtained by removing the solvent from the solution, the [Crystalline Resin Precursor E'-2] has a melting point of 57° C.

The raw materials for use in manufacturing the crystalline resins and the characteristics of the crystalline resins are shown in Tables 2 to 4.

TABLE 2

| | | Crystalline resin A | | | | | |
|---|---|---|---|---|---|---|---|
| | | Polyurethane resin | | Urethane-modified polyester resin | | | |
| | | D-1 | | D-2 | | D-3 | |
| | | Parts | Mol number | Parts | Mol number | Parts | Mol number |
| Alcohol component | 1,4-butane diol | 45 | 0.50 | | | | |
| | 1,6-hexane diol | 59 | 0.50 | 177 | 1.50 | | |
| Carboxylic acid component | Adipic acid | | | 15 | 0.10 | 13 | 0.09 |
| | Sebacic acid | | | 202 | 1.00 | 185 | 0.91 |
| Isocyanate component | Hexamethylene diisocyanate (HDI) | | | | | 12 | 0.07 |
| | 4,4'-diphenyl methane diisocyanate (MDI) | 250 | 1.00 | 30 | 0.12 | | |
| Catalyst (parts) | Titanium dihydroxybis (triethanol aminate) | | | | | | 0.5 |
| | Tetrabuthoxy titanate | | | | 0.5 | | |
| | Dibutyl tin oxide | | | | | | |
| | Melting point (Tm) ° C. | 60 | | 62 | | 63 | |
| | Softening point (Tb) ° C. | 72 | | 70 | | 75 | |
| | Tb/Tm | 1.20 | | 1.13 | | 1.19 | |
| | Mw | 20000 | | 22000 | | 39000 | |

TABLE 2-continued

| | | Crystalline resin A | | | |
|---|---|---|---|---|---|
| | | Urethane-modified polyester resin D-4 | | Polyester resin D-5 | |
| | | Parts | Mol number | Parts | Mol number |
| Alcohol component | 1,4-butane diol | | | | |
| | 1,6-hexane diol | 149 | 1.26 | 130 | 1.10 |
| Carboxylic acid component | Adipic acid | | | | |
| | Sebacic acid | 202 | 1.00 | 202 | 1.00 |
| Isocyanate component | Hexamethylene diisocyanate (HDI) | | | | |
| | 4,4'-diphenyl methane diisocyanate (MDI) | 28 | 0.11 | | |
| Catalyst (parts) | Titanium dihydroxybis (triethanol aminate) | | | | |
| | Tetrabuthoxy titanate | 0.5 | | 0.5 | |
| | Dibutyl tin oxide | | | | |
| | Melting point (Tm) ° C. | 67 | | 62 | |
| | Softening point (Tb) ° C. | 77 | | 60 | |
| | Tb/Tm | 1.15 | | 0.97 | |
| | Mw | 30000 | | 27000 | |

TABLE 3

| | | Crystalline portion/non-crystalline portion block resin D-6 | |
|---|---|---|---|
| | | Parts | Mol number |
| Non-crystalline resin portion | 1,2-propylene glycol | 25 | 0.33 |
| | 4,4'diphenyl methane diisocyanate (MDI) | 147 | 0.59 |
| Crystalline resin portion | 1,6-hexane diol | 160 | 1.35 |
| | Sebacic acid | 202 | 1.00 |
| Catalyst (parts) | Tetrabothoxy titanate | 0.5 | |
| | Melting point (Tm) ° C. | 62 | |
| | Mw | 26000 | |

TABLE 4

| | | Crystalline resin (E) Urethane-modified polyester resin E-1 | | Precursor of crystalline resin E'-2 | |
|---|---|---|---|---|---|
| | | Parts | Mol number | Parts | Mol number |
| Alcohol component | 1,6-hexane diol | 132 | 1.12 | 130 | 1.10 |
| Carboxylic acid | Sebacic acid | 113 | 0.56 | 202 | 1.00 |
| | Dimethyl terephthalate | 109 | 0.56 | | |
| Isocyanate component | Hexamethylene diisocyanate (HDI) | 10 | 0.06 | 27 | 0.16 |

TABLE 4-continued

| | | Crystalline resin (E) Urethane-modified polyester resin E-1 | | Precursor of crystalline resin E'-2 | |
|---|---|---|---|---|---|
| | | Parts | Mol number | Parts | Mol number |
| Catalyst (parts) | Titanium dihydroxy bis(triethanol aminate) | 0.5 | | 0.5 | |
| | Melting point (Tm) ° C. | 65 | | 57 | |
| | Softening point (Tb) ° C. | 76 | | 64 | |
| | Tb/Tm | 1.17 | | 1.12 | |
| | Mw | 63000 | | 54000 | |

Manufacturing Example 16

Manufacturing of Non-Crystalline Resin F-1

Place 222 parts of an adduct of bisphenol with 2 mol of EO, 129 parts of an adduct of bisphenol with 2 mol of PO, 166 parts of isophthalic acid, and 0.5 parts of tetrabuthoxy titanate as a condensing catalyst in a reaction container equipped with a condenser, a stirrer, and a nitrogen introducing tube to conduct reaction at 230° C. for eight hours in a nitrogen atmosphere while distilling away produced water. Next, conduct reaction at a reduced pressure of from 5 mmHg to 20 mmHG, cool down to 180° C. when the acid value is 2, add 35 parts to trimellitic anhydride, and conduct reaction at normal pressure for three hours to obtain [Non-Crystalline Resin F-1]. The thus-obtained [Non-Crystalline Resin F-1] has an Mw of 8,000, a glass transition temperature (Tg) of 62° C., a softening point (Tb) of 146° C., a maximum peak temperature of 68° C., and a ratio (softening point/maximum peak temperature) of 2.25.

Manufacturing Example 17

Manufacturing of Non-Crystalline Resin Precursor F'-2

Place 720 parts of an adduct of bisphenol A with 2 mol of EO, 90 parts of an adduct of bisphenol A with 2 mol of PO, 290 parts of terephthalic acid, and 1 part of tetrabuthoxy titanate as a condensing catalyst in a reaction container equipped with a condenser, a stirrer, and a nitrogen introducing tube to conduct reaction at 230° C. for eight hours in a nitrogen atmosphere while distilling away produced water. Conduct reaction under a reduced pressure of from 10 mmHG to 15 mmHg for seven hours to obtain {Non-Crystalline Resin].

Next, place 400 parts of the thus-obtained {Non-Crystalline Resin], 95 parts of isophorone diisocyanate, and 500 parts of ethyl acetate in a reaction container equipped with a condenser, a stirrer, and a nitrogen introducing tube to conduct reaction at 80° C. in a nitrogen atmosphere for eight hours to obtain a 50% by weight ethyl acetate solution of [Non-Crystalline Resin Precursor F'-2] having an isocyanate group at its end. Examples 1 and 19 and Comparative Examples 1 and 5

Manufacturing of Toner

Manufacturing of Graft Polymer

Place and sufficiently dissolve 480 parts of xylene and 100 parts of a low molecular weight polyethylene (SANWAX LEL-400 having a softening point of 128° C., manufactured by SANYO CHEMICAL INDUSTRIES, LTD.) in a reaction container equipped with a stirrer and a thermometer for nitrogen substitution, drip a liquid mixture of 740 parts of styrene, 100 parts of acrylonitrile, 60 parts of butylacrylate, 36 parts of di-t-butyl peroxyhexa hydroterephthalate, and 100 parts of xylene at 170° C. in three hours for polymerization, and maintain the system at this temperature for 30 minutes. Next, remove the solvent to synthesize a [Graft Polymer]. The thus-obtained [Graft Polymer] has an Mw of 24,000 and a Tg of 67° C.

Preparation of [Liquid Dispersion 1 of Releasing Agent] to [Liquid Dispersion 10 of Releasing Agent]

Place 50 parts of a mixture of the releasing agents 1 and 2 [Blending ratio as shown in Table 5: Releasing agent 1:Releasing agent 2=55/45 (% by weight)], 30 parts of the [Graft Polymer], and 420 parts of ethyl acetate in a reaction container equipped with a stirrer and a thermometer, raise the temperature thereof to 80° C. while stirring, maintain the system at 80° C. for five hours, cool down it to 30° C. in one hour, and conduct dispersion under the conditions of a liquid transfer speed of 1 kg/hour, a disk peripheral speed of 6 m/s, and a filling ratio of 0.5 mm zirconia beads of 80% by volume with three passes to obtain [Liquid Dispersion 1 of Releasing Agent].

Prepare [Liquid Dispersion 2 of Releasing Agent] to [Liquid Dispersion 10 of Releasing Agent] in the same manner as in manufacturing of [Liquid Dispersion 1 of Releasing Agent] except for changing as shown in Table 5.

TABLE 5

| | Releasing agent | | | |
|---|---|---|---|---|
| Liquid dispersion 1 of releasing agent | Releasing agent 1 | 55 | Releasing agent 2 | 45 |
| Liquid dispersion 2 of releasing agent | Releasing agent 1 | 60 | Releasing agent 2 | 40 |
| Liquid dispersion 3 of releasing agent | Releasing agent 1 | 54 | Releasing agent 3 | 46 |
| Liquid dispersion 4 of releasing agent | Releasing agent 1 | 55 | Releasing agent 6 | 45 |
| Liquid dispersion 5 of releasing agent | Releasing agent 1 | 45 | Releasing agent 6 | 55 |
| Liquid dispersion 6 of releasing agent | Releasing agent 2 | 55 | Releasing agent 6 | 45 |
| Liquid dispersion 7 of releasing agent | Releasing agent 4 | 55 | Releasing agent 5 | 45 |

TABLE 5-continued

| | Releasing agent | | | | | | | |
|---|---|---|---|---|---|---|---|---|
| Liquid dispersion 8 of releasing agent | Releasing agent 4 | 55 | Releasing agent 7 | 45 | | | | |
| Liquid dispersion 9 of releasing agent | Releasing agent 5 | 55 | Releasing agent 6 | 45 | | | | |
| Liquid dispersion 10 of releasing agent | Releasing agent 1 | 25 | Releasing agent 2 | 25 | Releasing agent 3 | 25 | Releasing agent 4 | 25 |

Preparation of Master Batch 1 to 7

Crystalline Polyrethane Resin D-1: 100 parts

Carbon black (Printex 35, DBP oil absorption amount: 42 ml/100 g, pH: 9.5, manufactured by DEGUSSA AG): 100 parts Deionized water 50 parts Mix the raw materials specified above by using a HENSCEL MIXER(NIPPON COKE & ENGINEERING CO., LTD.).

Mix and knead the thus-obtained mixture with a two-roll mill. Start the mixing and the kneading at 90° C. and cool the mixture down gradually to 50° C. Pulverize the thus-obtained mixture by a pulverizer (manufactured by HOSOKAWA MICRON CORPORATION) to manufacture [Master Batch 1].

Prepare [Master Batch 2] to [Master Batch 10] in the same manner as in manufacturing of [Master Batch 1] except for changing the binder resins as shown in Table 6.

TABLE 6

| | Binder resin |
|---|---|
| Master batch 1 | D-1 |
| Master batch 2 | D-2 |
| Master batch 3 | D-3 |
| Master batch 4 | D-4 |
| Master batch 5 | D-5 |
| Master batch 6 | D-6 |
| Master batch 7 | F-1 |

Manufacturing of Oil Phase 1 to 8 and 11 to 24

Place 31.5 parts of {Urethane Modified Crystalline Polyester Resin D-2] in a reaction container equipped with a stirrer and a thermometer followed by an addition of ethyl acetate in order to have a solid portion concentration of 50% by weight, and dissolve the resin sufficiently by heating the system to temperatures higher than the melting point of the resin.

Add to the solution a resin solution in which 50 parts of [Non-Crystalline Resin F-1] is dissolved by adding ethyl acetate in order to have a solid portion concentration of 50% by weight, 60 parts of [Releasing Agent Liquid Dispersion 1], and 12 parts of [Master Batch 2], and uniformly dissolve and disperse them by stirring by a TK type HOMOMIXER (manufactured by PRIMIX Corporation) at 50° C. at 5,000 rotation per minute (rpm) to obtain [Oil Phase 1].

Maintain the temperature of the [Oil Phase 1] in the container to keep 50° C. and use it within five hours of manufacturing before it is crystallized.

Manufacture [Oil Phase 2] to [Oil Phase 8] and [Oil Phase 11] to [Oil Phase 24] in the same manner as in [Oil Phase 1] except for changing the kind and the addition amount (parts) of the [Crystalline Resin D], the kind and the addition amount (parts) of the [Crystalline Resin E], the addition amount (parts) of the [Non-Crystalline Resin F], and the kind of {Master Batch] as shown in Table 7. Use the [Crystalline Resin E-1] in Table 7 by dissolving and dispersing together with the other toner raw materials in the oil phase manufacturing process. Use the [Crystalline Resin Precursor E-2] or [Non-Crystalline Resin Precursor F'-2] by adding, dissolving, and dispersing it to the oil phase during manufacturing process described later of mother toner particles instead of the oil phase manufacturing.

TABLE 7

| | Binder resin | | | | | | | | | Liquid dispersion of |
|---|---|---|---|---|---|---|---|---|---|---|
| | Crystalline resin D | | Crystalline resin E | | Non-crystalline resin F | | | | Master batch | releasing agent |
| Oil phase 1 | D-2 | 31.5 | E'-2 | 23.5 | F-1 | 50 | — | — | 2 | 1 |
| Oil phase 2 | D-2 | 46.5 | E'-2 | 17.5 | F-1 | 30 | — | — | 2 | 1 |
| Oil phase 3 | D-2 | 54 | E'-2 | 20 | F-1 | 20 | — | — | 2 | 4 |
| Oil phase 4 | D-2 | 54 | E'-2 | 20 | F-1 | 20 | — | — | 2 | 5 |

TABLE 7-continued

| | Binder resin | | | | | | | | | Liquid dispersion of |
|---|---|---|---|---|---|---|---|---|---|---|
| | Crystalline resin D | | Crystalline resin E | | Non-crystalline resin F | | | | Master batch | releasing agent |
| Oil phase 5 | D-2 | 54 | E'-2 | 20 | F-1 | 20 | — | — | 2 | 6 |
| Oil phase 6 | D-2 | 54 | E'-2 | 20 | F-1 | 20 | — | — | 2 | 3 |
| Oil phase 7 | D-2 | 54 | E'-2 | 20 | F-1 | 20 | — | — | 2 | 7 |
| Oil phase 8 | D-2 | 54 | E-1 | 20 | F-1 | 20 | — | — | 2 | 1 |
| Oil phase 11 | D-4 | 54 | E'-2 | 20 | F-1 | 20 | — | — | 4 | 1 |
| Oil phase 12 | D-3 | 54 | E'-2 | 20 | F-1 | 20 | — | — | 3 | 1 |
| Oil phase 13 | D-1 | 54 | E'-2 | 20 | F-1 | 20 | — | — | 1 | 1 |
| Oil phase 14 | D-5 | 54 | E'-2 | 20 | F-1 | 20 | — | — | 5 | 1 |
| Oil phase 15 | D-6 | 54 | E'-2 | 20 | F-1 | 20 | — | — | 6 | 1 |
| Oil phase 16 | D-2 | 54 | E'-2 | 20 | F-1 | 20 | — | — | 2 | 1 |
| Oil phase 17 | D-2 | 54 | E'-2 | 20 | F-1 | 20 | — | — | 2 | 9 |
| Oil phase 18 | D-2 | 54 | E'-2 | 20 | F-1 | 20 | — | — | 2 | 2 |
| Oil phase 19 | D-2 | 54 | E'-2 | 20 | F-1 | 20 | — | — | 2 | 10 |
| Oil phase 20 | D-2 | 54 | E'-2 | 20 | F-1 | 20 | — | — | 2 | 8 |
| Oil phase 21 | D-2 | 15 | — | — | F-1 | 62 | F'-2 | 17 | 7 | 1 |
| Oil phase 22 | D-2 | 18.5 | E'-2 | 8.5 | F-1 | 67 | — | — | 2 | 1 |
| Oil phase 23 | D-1 | 28 | E'-2 | 18 | F-1 | 48 | — | — | 1 | 1 |
| Oil phase 24 | D-2 | 28 | — | — | F-1 | 49 | F'-2 | 17 | 7 | 1 |

Manufacturing of Water Liquid Dispersion of Resin Particulate

Place 600 parts of water, 120 parts of styrene, 100 parts of methacrylic acid, 45 parts of butyl acrylate, 10 parts of a sodium salt of alkyl aryl sulfonic acid (ELEMINOL JS-2, manufactured by Sanyo Chemical Industries, Ltd.), and 1 part of ammonium persulfate in a reaction container equipped with a stirrer and a thermometer and stir them at 400 rpm for 20 minutes to obtain a while emulsion.

Heat the emulsion until the temperature in the system is 75° C. to conduct reaction for six hours. Furthermore, add 30 parts of an aqueous solution of 1% by weight ammonium persulfate and age the system for six hours at 75° C. to obtain [Water Liquid Dispersion of Resin Particulate]. The volume average particle diameter of the particles contained in this [Water Liquid Dispersion of Resin Particulate] is 80 nm, the weight average molecular weight of the resin portion is 160,000, and the glass transition temperature is 74° C.

Preparation of Aqueous Phase 1 and 2

Mix and stir 990 parts of water, 83 parts of [Water Liquid Dispersion of Resin Particulate], 37 parts of 48.5% by weight aqueous solution of sodium dodecyldiphenyl etherdisulfonate (EREMINOR MON-7, manufactured by Sanyo Chemical Industries, Ltd.), and 90 parts of ethyl acetate to obtain [Aqueous Phase 1].

Prepare [Aqueous Phase 2] in the same manner as in manufacturing of [Aqueous Phase 1] except for removing [Water Liquid Dispersion of Resin Particulate] from the raw materials of [Aqueous Phase 1].

Manufacturing of Mother Toner 1 to 8

Place 520 parts of [Aqueous Phase 1] in a reaction container equipped with a stirrer and a thermometer followed by heating to 40° C. Add 25 parts of an ethyl acetate solution of [Crystalline Resin Precursor E'-2] to 235 parts of [Oil Phase 1] maintained at 50° C., stir them by a TK type HOMOMIXER (manufactured by PRIMIX Corporation) at 5,000 rpm, and uniformly dissolve and disperse them to prepare [Oil Phase 1']. Add [Oil Phase 1'] to [Aqueous Phase 1] maintained at 45° C. to 50° C. while stirring by a TK type HOMOMIXER (manufactured by PRIMIX Corporation) at 13,000 rpm for emulsification for one minute to obtain [Emulsified Slurry 1].

Put [Emulsified Slurry 1] in a container equipped with a stirrer and a thermometer followed by removing the solvent at 60° C. for six hours to obtain [Slurry 1]. Filtrate the thus-obtained [Slurry 1] with a reduced pressure followed by the following washing treatment:

(1): Add 100 parts of deionized water to the filtered cake and mix the resultant by a TK HOMOMIXER at 6,000 rpm for five minutes followed by filtration;

(2): Add 100 parts of an aqueous solution of 10% sodium hydroxide to the filtered cake obtained in (1) and mix the resultant by a TK HOMOMIXER at 6,000 rpm for ten minutes followed by filtration with a reduced pressure;

(3): Add 100 parts of 10% by weight hydrochloric acid to the filtered cake obtained in (2) and mix the resultant by a TK HOMOMIXER at 6,000 rpm for five minutes followed by filtration;

(4): Add 300 parts of deionized water to the filtered cake obtained in (3) and mix the resultant by a TK HOMOMIXER at a rotation number of 6,000 rpm for five minutes followed by filtration twice to obtain [Filtered Cake 1]. Dry the [Filtered Cake 1] by a circulation drier at 45° C. for 48 hours. Screen the dried resultant by a mesh having an opening of 75 μm to obtain

[Mother Toner 1].

Prepare [Mother Toner 2] to [Mother Toner 7] in the same manner as in manufacturing of [Mother Toner 1] except for using [Oil Phase 2] to [Oil Phase 7], respectively, instead of [Oil Phase 1]. In addition, prepare [Mother Toner 8] in the same manner as in manufacturing of [Mother Toner 1] except for using [Aqueous Phase 2] and {Oil Phase 8].

Manufacturing of Liquid Dispersion D-2 of Crystalline Resin Particle

Add 60 parts of ethyl acetate to 60 parts of [Urethane-modified Crystalline Polyester Resin D-2] to dissolve it by mixing and stirring at 50° C. Next, add 120 parts of the resin solution to [Aqueous Phase] in which 120 parts of water, 6 parts of 48.3% by weight aqueous solution of sodium dodecyldiphenyl ether disulfonate (ELEMINOR MON-7, manufactured by Sanyo Chemical Industries, Ltd.), and 2.4 parts of 2% by weight aqueous solution of sodium hydroxide are mixed and emulsify them by a HOMOGENIZER (ULTRA-TURRAX T50 (manufactured by IKA JAPAN) followed by emulsification treatment by a MANTON-GAULIN high HOMOGENIZER (manufactured by GAULIN CORPORATION) to obtain [Emulsified Slurry D-2].

Put [Emulsified Slurry D-2] in a container equipped with a stirrer and a thermometer followed by removing the solvent at 60° C. for four hours to obtain [Liquid Dispersion D-2 of Crystalline Resin Particle]. Measure the volume average particle diameter of the thus-obtained [Liquid Dispersion D-2 of Crystalline Resin Particle] by a particle size distribution analyzer (LA-920, manufactured by HORIBA LTD.). The volume average particle diameter is 0.15 μm.

Manufacturing of Liquid Dispersion E-1 of Crystalline Resin Particle

Add 60 parts of ethyl acetate to 60 parts of [Urethane-modified Crystalline Polyester Resin E-1] to dissolve it by mixing and stirring at 50° C. Next, add 120 parts of the resin solution to [Aqueous Phase] in which 120 parts of water, 6 parts of 48.3% by weight aqueous solution of sodium dodecyldiphenyl ether disulfonate (EREMINOR MON-7, manufactured by Sanyo Chemical Industries, Ltd.), and 2.4 parts of 2% by weight aqueous solution of sodium hydroxide are mixed and emulsify them by a HOMOGENIZER (ULTRA-TURRAX T50 (manufactured by IKA JAPAN) followed by emulsification treatment by a MANTON-GAULIN high HOMOGENIZER (manufactured by GAULIN CORPORATION) to obtain [Emulsified Slurry E-1].

Put [Emulsified Slurry E-1] in a container equipped with a stirrer and a thermometer followed by removing the solvent at 60° C. for four hours to obtain [Liquid Dispersion E-1 of Crystalline Resin Particle]. Measure the volume average particle diameter of the thus-obtained [Liquid Dispersion E-1 of Crystalline Resin Particle] by a particle size distribution analyzer (LA-920, manufactured by HORIBA LTD.). The volume average particle diameter is 0.16 μm.

Manufacturing of Liquid Dispersion F-1 of Non-Crystalline Resin Particle

Add 60 parts of ethyl acetate to 60 parts of [Non-Crystalline Resin F-1] to dissolve it by mixing and stirring. Next, add 120 parts of the resin solution to [Aqueous Phase] in which 120 parts of water, 6 parts of 48.3% by weight aqueous solution of sodium dodecyldiphenyl ether disulfonate (ELEMINOR MON-7, manufactured by SANYO CHEMICAL INDUSTRIES, LTD.), and 2.4 parts of 2% by weight aqueous solution of sodium hydroxide are mixed and emulsify them by a HOMOGENIZER (ULTRA-TURRAX T50, manufactured by IKA JAPAN) followed by emulsification treatment by a MANTON-GAULIN high HOMOGENIZER (manufactured by GAULIN CORPORATION) to obtain [Emulsified Slurry F-1].

Put [Emulsified Slurry F-1] in a container equipped with a stirrer and a thermometer followed by removing the solvent at 60° C. for four hours to obtain [Liquid Dispersion F-1 of Crystalline Resin Particle]. Measure the volume average particle diameter of the thus-obtained [Liquid Dispersion F-1 of Crystalline Resin Particle] by a particle size distribution analyzer (LA-920, manufactured by HORIBA LTD.). The volume average particle diameter is 0.15 μm.

Preparation of Liquid Dispersion 11 of Releasing Agent

Mix 25 parts of a mixture of the releasing agents 1 and 2 [Blending ratio: Releasing agent 1: Releasing agent 2=55/45 (% by weight)], 5 parts of anion surface active agent (ELEMINOL MON-7, manufactured by PRIMIX CORPORATION), and 200 parts of water and melt them at 95° C. Next, emulsify this liquid fusion by a HOMOGENIZER (ULTRA-TURRAX T50, manufactured by IKA JAPAN) followed by emulsification treatment by a MANTON-GAULIN high HOMOGENIZER (manufactured by GAULIN CORPORATION) to obtain [Liquid Dispersion 11 of Releasing Agent].

Preparation of Liquid Dispersion of Coloring Agent

Mix 20 parts of carbon black (Printex 35, manufactured by DEGUSSA AG), 2 parts of anion surface active agent (ELEMINOR MON-7, manufactured by SANYO CHEMICAL INDUSTRIES, LTD.), and 80 parts of water followed by dispersion by a TK type HOMOMIXER (manufactured by PRIMIX CORPORATION).

Manufacturing of Mother Toner 9

Mix 190 parts of [Liquid Dispersion D-2 of Crystalline Resin Particle], 63 parts of [Liquid Dispersion E-1 of Crystalline Resin Particle], 63 parts of [Liquid Dispersion F-1 of Non-Crystalline Resin Particle], 46 parts of [Liquid Dispersion 11 of Releasing Agent], 17 parts of [Liquid Dispersion of Coloring Agent], and 600 parts of water followed by adjusting the pH thereof by 2% by weight aqueous solution of sodium hydroxide to become a pH of 10.

Then, while stirring and dripping gradually to the solution 50 parts of a 10% by weight aqueous solution of magnesium chloride, heat the system to 60° C.

Maintain the temperature at 60° C. until the agglomerated particles grow to have a volume average particle diameter of 5.3 μm to obtain [Slurry 9]. Filtrate the thus-obtained [Slurry 9] with a reduced pressure followed by the washing treatment (1) to (4) described above to obtain [Filtered Cake 9]: Dry the thus-obtained [Filtered Cake 9] by a circulation drier at 45° C. for 48 hours. Screen the dried resultant by a mesh having an opening of 75 μm to obtain [Mother Toner 9].

Manufacturing of Mother Toner 10

Preliminarily mix 60 parts of [Urethane-modified Crystalline Polyester Resin D-2], parts of [Urethane-modified Crystalline Polyester Resin E-1], 20 parts of [Non-crystalline Resin F-1], 6 parts of a mixture of the releasing agents 1 and 2 [Blending ratio: Releasing agent 1: Releasing agent 2=55/45 (% by weight)], and 12 parts of [Master Batch 2] by a HENSCEL MIXER (FM10B, manufactured by NIPPON COKE & ENGINEERING CO., LTD.) followed by melting and mixing and kneading at 80° C. to 120° C. by a two-shaft kneader (PCM-30, manufactured by Ikegai Corp.). Cool down the thus-obtained mixture to room temperature followed by coarse-pulverization by a hammer mill to 200 μm to 300 μm. Finely-pulverize the resultant by a supersonic jet mill (Labojet, manufactured by NIPPON PNEUMATIC MFG. Co., LTD.) in order to obtain a weight average particle diameter of from 5.9 μm to 6.5 μm while adjusting the pulverization air pressure and classify the resultant by an air current classifier (MDS-1, manufactured by NIPPON PNEUMATIC MFG. Co., LTD.) in order that the weight average particle diameter is from 6.8 μm to 7.2 μm and the amount of fine powder having a weight average particle diameter of 4 μm or less is 10% by number or less while adjusting the louver opening to obtain [Mother Toner 10].

Manufacturing of Mother Toner 11 to Mother Toner 24

Prepare [Mother Toner 11] to [Mother Toner 24] in the same manner as in manufacturing of [Mother Toner 1] except for using [Oil Phase 11] to [Oil Phase 24], respectively, instead of [Oil Phase 1]

Manufacturing of Toner 1 to Toner 24

Mix 100 parts of the thus-obtained [Mother Toner 1] to [Mother Toner 24], 1.0 part of hydrophobic silica (MK-2000, manufactured by WACKER-CHEMIE AG) serving as an external additive by a HENSCEL MIXER (manufactured by NIPPON COKE & ENGINEERING CO., LTD.) at a peripheral speed of 30 m/s for 30 seconds followed by one-minute break. Repeat this cycle five times and screen the resultant with a mesh having an opening of 35 μm to manufacture [Toner 1] to {Toner 24].

Measure the particle size distribution (Dv, Dn, and DV/Dn) and the crystallinity of the thus-obtained [Toner 1] to [Toner 24]. The results are shown in Table 8.

Manufacturing of Carrier

Silicone resin (Organo straight silicone): 100 parts

γ-(2-aminoethyl)aminopropyl trimethoxy silane: 5 parts

Carbon Black: 10 parts

Toluene 100 parts

Disperse the recipe specified above by a Homomixer for 20 minutes to prepare a liquid cover for forming a resin (cover) layer. Using a fluid bed type coating device, apply a liquid cover of resin layer to the surface of 1,000 parts of sphere ferrite having a volume average particle diameter of 35 μm to manufacture a carrier.

Manufacturing of Development Agent

Mix 5 parts of each of [Toner 1] to [Toner 24] and 95 parts of the carrier to manufacture each development agent of Examples 1 to 19 and Comparative Examples 1 to 5.

Next, using the thus-obtained development agent, evaluate the fixability, (lowest fixing temperature, fixing range), high-temperature stability, and contamination in the machine to make a total evaluation. The results are shown in Table 8.

Low-Temperature Fixability (Lowest Fixing Temperature)

Using the tandem-type full color image forming apparatus 100C illustrated in FIG. 4, form a solid image (image size: 3 cm×8 cm) on the entire transfer sheet (Photocopying paper <70>, manufactured by RICOH BUSINESS EXPERT CO., LTD.) with an attachment amount of toner of from 0.75 mg/cm$^2$ to 0.95 mg/cm$^2$ after transfer and fix the image while changing the temperature of the fixing belt. Draw an image by a drawing tester (AD-401, manufactured by UESHIMA SEISAKUSHO CO., LTD.) with a ruby needle (point radius: 260 μmR to 320 μmR, a point angle: 60 degree) under a load of 50 g using the thus-obtained fixed image and rub the surface of the drawn image violently five times by fiber (HONECOTTO #440, manufactured by SAKATA INX ENG. CO., LTD.).

Compare the temperature of the fixing belt at which almost no image scraping occurs with the temperature below which cold offset occurs (the lowest temperature below which the fixed image does not adhere to a transfer paper sufficiently and the unfixed toner is transferred to the belt once and fixed to a transfer sheet next image formation operation, resulting in production of defective images) and define the higher temperature as the lowest fixing temperature. In addition, form the solid image at a position 3.0 cm from the leading end of the transfer sheet relative to the transfer direction. The speed of the transfer sheet passing through the nipping portion of the fixing device is 280 mm/s. The lower the lowest fixing temperature is, the better the low-temperature fixability is.

Evaluation Criteria

When the lowest fixing temperature is below 110° C.: Excellent

When the lowest fixing temperature is from 110° C. to lower than 115° C.: Good

When the lowest fixing temperature is from 115° C. to lower than 130° C.: Fair

When the lowest fixing temperature is 130° C. or higher: Intolerance

The lowest fixing temperature below 130° C. is determined as allowable and the lowest fixing temperature equal to 130° C. or higher is non-tolerable.

Fixability (Hot Offset Resistance•Fixing Temperature Range)

Using the tandem-type full color image forming apparatus 100C illustrated in FIG. 4, form a solid image (image size: 3 cm×8 cm) on the entire transfer sheet (TYPE 6200, manufactured by RICOH CO., LTD.) with an attachment amount of toner of from 0.75 mg/cm$^2$ to 0.95 mg/cm$^2$ after transfer and fix the image while changing the temperature of the fixing belt.

Observe whether hot offset (causing a defective image produced when the fixed image is excessively melted and fused on the transfer sheet and the melted toner is transferred to the belt once and fixed on a transfer sheet in the next image formation operation) has occurred with naked eyes.

Define the difference between the upper limit temperature above which hot offset occurs and the lowest fixing temperature as the fixing temperature range.

In addition, form the solid image at a position 3.0 cm from the leading end of the transfer sheet relative to the transfer direction.

The speed of the transfer sheet passing through the nipping portion of the fixing device is 280 mm/s.

The wider the fixing temperature range is, the better the hot offset resistance is. The average temperature range of typical full color toner is about 50° C.

Evaluation Criteria

Fixing temperature range broader than 100° C.: Excellent

Fixing temperature range of from 70° C. to narrower than 100° C.: Good

Fixing temperature range of from 55° C. to lower than 70° C.: Fair

Fixing temperature range is narrower than 55° C.: Causing problem

The fixing temperature range is 55° C. or broader is determined as allowable and the fixing temperature range equal to 55° C. or narrower is unacceptable.

High-Temperature Stability (Needle Penetration Level)

Fill a glass container with the toner and leave it in a constant bath at 50° C. for 24 hours. Subsequent to cooling-down to 24° C., measure the needle penetration level of the toner by a needle penetration test (according to JIS K2235-1991) to evaluate the toner by the following criteria:

A large needle penetration value represents excellent high-temperature stability. Toner having a needle penetration level less than 5 mm is likely to cause a practical problem.

Evaluation Criteria

E: (Excellent): G: (Good) F: (Fair) B: (Bad) (causing practical problem)

E, G, and F are acceptable and B is unacceptable.

E (Excellent): 25 mm or greater

G (Good): 15 mm to less than 25 mm

F (Fair): 5 mm to less than 15 mm

B (Bad): less than 5 mm

Contamination in Machine

Using the tandem-type full color image forming apparatus 100C illustrated in FIG. 4, output a test image with a run length of 100,000 and observe the amount of the volatile component attached to the cover located above the fixing temperature belt with naked eyes to make an evaluation by the following conditions:

This volatile component melts and drops during operation if increasing the run length, thereby contaminating images.

Evaluation Criteria

E: (Excellent): G: (Good)

F: (Fair)

B: (Bad) (causing practical problem)

E, G, and F are acceptable and B is unacceptable.

E: No attachment of contaminating composition observed

G: Attachment of contaminating composition slightly observed

F: Attachment of contaminating composition observed but causing no practical problem B: Melted contaminating component drops on image, resulting in a practical problem.

TABLE 8

| | | Crystalline resin ratio | Dv (μm) | Dn (μm) | Dv/Dn | Content of component A (number of carbon atoms): Na | Content of component B (number of carbon atoms): Nb | Na − Nb |
|---|---|---|---|---|---|---|---|---|
| Example 1 | Toner 1 | 50 | 6.0 | 5.2 | 1.15 | 49.6 (C44) | 42.9 (C42) | 2 |
| Example 2 | Toner 2 | 70 | 5.7 | 5.0 | 1.14 | 49.6 (C44) | 42.9 (C42) | 2 |
| Example 3 | Toner 3 | 80 | 5.9 | 5.1 | 1.16 | 49.3 (C44) | 38.9 (C30) | 14 |
| Example 4 | Toner 4 | 80 | 5.2 | 4.5 | 1.16 | 47.6 (C30) | 40.3 (C44) | −14 |
| Example 5 | Toner 5 | 80 | 5.7 | 5.0 | 1.14 | 48.5 (C42) | 38.9 (C30) | 12 |
| Example 6 | Toner 6 | 80 | 5.3 | 4.5 | 1.18 | 48.4 (C44) | 40.9 (C40) | 4 |
| Example 7 | Toner 7 | 80 | 5.4 | 4.6 | 1.17 | 49.4 (C36) | 43.7 (C34) | 2 |
| Example 8 | Toner 8 | 80 | 6.8 | 5.5 | 1.24 | 49.6 (C44) | 42.9 (C42) | 2 |
| Example 9 | Toner 9 | 80 | 5.8 | 4.9 | 1.18 | 49.6 (C44) | 42.9 (C42) | 2 |
| Example 10 | Toner 10 | 80 | 6.3 | 4.8 | 1.31 | 49.6 (C44) | 42.9 (C42) | 2 |
| Example 11 | Toner 11 | 80 | 5.9 | 5.1 | 1.16 | 49.6 (C44) | 42.9 (C42) | 2 |
| Example 12 | Toner 12 | 80 | 5.7 | 4.9 | 1.16 | 49.6 (C44) | 42.9 (C42) | 2 |
| Example 13 | Toner 13 | 80 | 5.1 | 4.4 | 1.16 | 49.6 (C44) | 42.9 (C42) | 2 |
| Example 14 | Toner 14 | 80 | 5.6 | 4.8 | 1.17 | 49.6 (C44) | 42.9 (C42) | 2 |
| Example 15 | Toner 15 | 80 | 6.2 | 5.4 | 1.15 | 49.6 (C44) | 42.9 (C42) | 2 |
| Example 16 | Toner 16 | 80 | 5.4 | 4.7 | 1.15 | 49.6 (C44) | 42.9 (C42) | 2 |
| Example 17 | Toner 17 | 80 | 5.2 | 4.6 | 1.13 | 48.5 (C34) | 40.1 (C30) | 4 |

TABLE 8-continued

| | | | | | | | | |
|---|---|---|---|---|---|---|---|---|
| Example 18 | Toner 22 | 33 | 5.1 | 4.5 | 1.13 | 49.6 (C44) | 42.9 (C42) | 2 |
| Example 19 | Toner 23 | 52 | 5.3 | 4.6 | 1.15 | 49.6 (C44) | 42.9 (C42) | 2 |
| Comparative Example 1 | Toner 18 | 80 | 5.4 | 4.6 | 1.17 | 54.1 (C44) | 38.8 (C42) | 2 |
| Comparative Example 2 | Toner 19 | 80 | 5.8 | 5.0 | 1.16 | 24.0 (C40) | 23.7 (C42) | 2 |
| Comparative Example 3 | Toner 20 | 80 | 5.5 | 4.8 | 1.15 | 49.2 (C36) | 4.0 (C34) | 2 |
| Comparative Example 4 | Toner 21 | 15 | 5.5 | 4.7 | 1.17 | 49.6 (C44) | 42.9 (C42) | 2 |
| Comparative Example 5 | Toner 24 | 28 | 5.7 | 4.9 | 1.16 | 49.6 (C44) | 42.9 (C42) | 2 |

| | | | | | Fixability | | | |
|---|---|---|---|---|---|---|---|---|
| | | A + B | A + B + C | Crystal-linity (%) | Lowest fixing temp. (° C.) | Fixing range (° C.) | High temp. stability | Contamination in the machine |
| Example 1 | Toner 1 | 92.5 | 95.9 | 15 | 120 | 55 | F | E |
| Example 2 | Toner 2 | 92.5 | 95.9 | 21 | 105 | >100 | E | E |
| Example 3 | Toner 3 | 88.2 | 91.4 | 26 | 115 | 70 | F | G |
| Example 4 | Toner 4 | 87.9 | 90.5 | 26 | 115 | 70 | F | F |
| Example 5 | Toner 5 | 87.4 | 91.3 | 27 | 110 | >100 | G | E |
| Example 6 | Toner 6 | 89.3 | 92.7 | 25 | 105 | >100 | G | E |
| Example 7 | Toner 7 | 93.1 | 94.9 | 24 | 105 | 85 | E | E |
| Example 8 | Toner 8 | 92.5 | 95.9 | 26 | 105 | 70 | E | E |
| Example 9 | Toner 9 | 92.5 | 95.9 | 25 | 105 | 70 | E | E |
| Example 10 | Toner 10 | 92.5 | 95.9 | 26 | 110 | 70 | G | G |
| Example 11 | Toner 11 | 92.5 | 95.9 | 22 | 105 | >100 | E | E |
| Example 12 | Toner 12 | 92.5 | 95.9 | 28 | 110 | >100 | E | E |
| Example 13 | Toner 13 | 92.5 | 95.9 | 14 | 115 | >100 | F | E |
| Example 14 | Toner 14 | 92.5 | 95.9 | 37 | 105 | >100 | G | E |
| Example 15 | Toner 15 | 92.5 | 95.9 | 22 | 105 | >100 | E | E |
| Example 16 | Toner 16 | 92.5 | 95.9 | 27 | 105 | >100 | E | E |
| Example 17 | Toner 17 | 88.6 | 92.8 | 26 | 105 | 70 | F | F |
| Example 18 | Toner 22 | 92.5 | 95.9 | 10 | 125 | 55 | F | E |
| Example 19 | Toner 23 | 92.5 | 95.9 | 9 | 125 | 55 | F | E |
| Comparative Example 1 | Toner 18 | 92.8 | 95.9 | 24 | 120 | 35 | E | E |
| Comparative Example 2 | Toner 19 | 47.7 | 70.3 | 26 | 120 | 30 | F | B |
| Comparative Example 3 | Toner 20 | 53.2 | 53.4 | 27 | 115 | 40 | B | B |
| Comparative Example 4 | Toner 21 | 92.5 | 95.9 | 5 | 140 | 55 | G | E |
| Comparative Example 5 | Toner 24 | 92.5 | 95.9 | 9 | 130 | 55 | B | E |

The development agents of Examples 1 to 19 are excellent about the low-temperature fixability, wide fixing temperature range, and good about the high-temperature stability and the contamination in the machine in comparison with the development agents of Comparative Examples 1 to 5.

What is claimed is:

1. A toner comprising:

a binder resin;

a coloring agent; and a releasing agent consisting of an ester wax, wherein the ester wax comprises two or more kinds of alkyl monoester compounds having a different number of carbon atoms in a range of from 30 to 50 carbon atoms, the toner having a crystallinity of 10% or more as measured by x-ray diffraction and/or the binder resin comprising a crystalline resin in an amount of 50% by weight or more of the binder resin, the two or more kinds of alkyl monoester compounds including a component A accounting for the largest amount ranging from 30% by weight to less than 50% by weight of the ester wax and a component B accounting for the second largest amount ranging from 10% by weight to less than 50% by weight of the ester wax.

2. The toner according to claim 1, wherein an absolute difference between the number of carbon atoms Na in the component A and the number of carbon atoms Nb in the component B ranges from 1 to 12.

3. The toner according to claim 1, wherein the component A and the component B combined account for 90% by weight or more of the releasing agent.

4. The toner according to claim 1, wherein the two or more kinds of alkyl monoester compounds further comprises a component C having 30 to 50 carbon atoms different from those of the component A and the component B, wherein the component A, the component B, and the component C combined account for 95% by weight of the releasing agent.

5. The toner according to claim 1, wherein the two or more kinds of alkyl monoester compounds are obtained by esterification reaction of a long chain aliphatic carboxylic acid component having 14 to 30 carbon atoms and a long chain aliphatic alcohol component having 16 to 36 carbon atoms.

6. The toner according to claim 1, wherein the crystalline resin has at least one of a urethane bonding and a urea bonding.

7. The toner according to claim 1, wherein the crystalline resin comprises a crystalline resin D and a crystalline resin E, which have different weight average molecular weights (Mw).

8. The toner according to claim 1, wherein crystallinity ranges from 15% to 30%.

9. The toner according to claim 1, wherein the crystalline resin comprises a urethane-modified crystalline polyester resin obtained by elongation and cross-linking in reaction of a two or higher isocyanate compound and a polyester resin obtained by polycondensation of an alcohol component and a carboxylic acid component.

10. The toner according to claim 1, wherein the crystalline resin comprises a block polymer of a polyester and a polyurethane.

11. A development agent comprising the toner of claim 1.

12. An image forming apparatus comprising:

an image bearing member;

a charger to charge a surface of the image bearing member;

an irradiator to irradiate the surface of the image bearing member with light to form a latent electrostatic image thereon;

a development device to develop the latent electrostatic image with the toner of claim 1 to obtain a visual image;

a transfer device to transfer the visual image to a recording medium; and a fixing device to fix the visual image on the recording medium.

* * * * *